US012716187B2

(12) United States Patent
Hammer

(10) Patent No.: US 12,716,187 B2
(45) Date of Patent: Aug. 25, 2026

(54) WALL BLOCK SYSTEM

(71) Applicant: Westblock Systems, Inc., Tacoma, WA (US)

(72) Inventor: Eric Stanley Hammer, Antioch, TN (US)

(73) Assignee: Westblock Systems, Inc., Lake Forest Park, WA (US)

( * ) Notice: Subject to any disclaimer, the term of this patent is extended or adjusted under 35 U.S.C. 154(b) by 0 days.

(21) Appl. No.: 19/531,645

(22) Filed: Feb. 5, 2026

(65) Prior Publication Data

US 2026/0168195 A1 Jun. 18, 2026

Related U.S. Application Data

(60) Continuation-in-part of application No. 30/002,867, filed on May 8, 2025, which is a division of (Continued)

(51) Int. Cl.
*E02D 29/02* (2006.01)

(52) U.S. Cl.
CPC ..... *E02D 29/025* (2013.01); *E02D 29/0266* (2013.01)

(58) Field of Classification Search
CPC ..... E02D 29/025–0266
(Continued)

(56) References Cited

U.S. PATENT DOCUMENTS

D244,201 S 5/1977 Muse
D317,048 S 5/1991 Forsberg
(Continued)

FOREIGN PATENT DOCUMENTS

KR 300290369 1/2002
KR 301248422 1/2024
KR 301277708 10/2024

OTHER PUBLICATIONS

Baunovo Manufacturing LLC, photographs of a mold for forming concrete blocks and photographs and renderings of concrete blocks, received by Westblock Systems, Inc., Dec. 2025.
(Continued)

*Primary Examiner* — Tara Mayo
(74) *Attorney, Agent, or Firm* — Klarquist Sparkman, LLP

(57) ABSTRACT

A wall block includes an upper surface, a lower surface, and a body having a front portion, a rear portion, and an intermediate portion interconnecting the front and rear portions. The intermediate portion defines a minimum spacing between opposing outer side surfaces of the intermediate portion. The rear portion includes first and second tail sections disposed on opposite sides of a centerline of the block, each tail section having forward-facing and rearward-facing surfaces. First and second protrusions are formed on the upper surface on opposite sides of the centerline and are positioned closer to the rearward-facing surfaces of the tail sections than to a front surface of the block. Each protrusion is laterally spaced from a respective outer side of the block by a defined distance. The minimum spacing of the intermediate portion is less than twice the lateral spacing of each protrusion from the respective outer side.

20 Claims, 24 Drawing Sheets

Related U.S. Application Data application No. 29/877,198, filed on Jun. 2, 2023, now Pat. No. Des. 1,083,150.

(60) Provisional application No. 63/945,575, filed on Dec. 19, 2025.

(58) Field of Classification Search
USPC ..... 405/284, 286
See application file for complete search history.

(56) References Cited

U.S. PATENT DOCUMENTS

D343,461 S 1/1994 Powell
D347,070 S 5/1994 Anderson et al.
5,350,256 A 9/1994 Hammer
D363,786 S 10/1995 Sowders
5,490,363 A * 2/1996 Woolford ..... B28B 7/0097 52/169.4
5,653,558 A * 8/1997 Price ..... E04C 1/395 52/611
D397,230 S 8/1998 Forsberg
D405,543 S 2/1999 Shillingburg
D468,450 S 1/2003 Hammer
D532,119 S 11/2006 Hammer
D539,438 S 3/2007 Price
7,503,729 B2 3/2009 Hammer et al.
D604,865 S 11/2009 Rainey
D610,713 S 2/2010 Hammer
D611,106 S 3/2010 van Beek
D611,165 S 3/2010 Hammer
D650,918 S 12/2011 Hammer
D668,792 S 10/2012 Hammer
D689,203 S 9/2013 MacDonald
9,902,600 B2 2/2018 Hammer et al.
D992,763 S 7/2023 Hammer
D1,017,838 S 3/2024 French
D1,041,034 S 9/2024 Lundell
D1,042,890 S 9/2024 Stell
D1,101,209 S 11/2025 Lundell
2003/0012608 A1* 1/2003 Race ..... E02D 29/0241 405/284
2004/0161307 A1 8/2004 Hammer
2007/0094991 A1* 5/2007 Price et al. ..... E02D 29/025 52/605
2012/0233952 A1 9/2012 Hammer
2013/0049259 A1 2/2013 Hammer
2023/0090438 A1* 3/2023 Lundell ..... E02D 29/0258 405/284

OTHER PUBLICATIONS

Concrete website, Lowes, Earliest Internet Web Archive date Mar. 9, 2021, Available on the internet URL https://www.lowes.com/pd/16-Basic-Hardsplit-Retaining-Wall-Brown-Charcoal-Retaining-Wall-Block-Common-6-in-x-16-in-Actual -6-in-x-16-in/1001844888 (Year: 2021).

Westblock website, Gravity Stone, Earliest Internet Web Archive date Mar. 6, 2021, Available on the internet URL https//web.archive.org/web/20210306014220/https://www.westblocksystems.com/gravitystone-encore (Year: 2021).

* cited by examiner

WALL BLOCK SYSTEM

CROSS REFERENCE TO RELATED APPLICATIONS

This application claims the benefit of U.S. Provisional Patent Application No. 63/945,575, filed Dec. 19, 2025, which is incorporated herein by reference. This application is also a continuation-in-part of U.S. Design Application No. 30/002,867, filed May 8, 2025, which is a divisional of U.S. Design Application No. 29/877,198, filed Jun. 2, 2023, now U.S. Pat. No. D1,083,150, both of which applications are incorporated herein by reference.

FIELD

The present invention relates to blocks, such as concrete blocks, for constructing structures, such as retaining walls, free-standing walls, and columns.

BACKGROUND

Natural stone blocks cut from quarries have been used for a number of years to assemble walls of various types, including ornamental walls for landscaping purposes. Natural blocks have unique sizes, differences in shape and differences in appearance. However, construction of walls using such blocks requires significant skill to match, align, and place blocks so that the wall is erected with substantially uniform courses. While such walls provide an attractive ornamental appearance, the cost of quarried stone and the labor to assemble the stone blocks are generally cost prohibitive for most applications.

An attractive, low-cost alternative to natural stone blocks is molded concrete blocks. In fact, there are several, perhaps hundreds, of utility and design patents which relate to molded blocks and/or retaining walls made from such blocks. Nonetheless, there exists a continuing need for new and improved molded blocks and block systems and methods for constructing walls.

SUMMARY

The present disclosure blocks, such as concrete blocks, for constructing structures, such as retaining walls, free-standing walls, and columns.

In some examples, a wall block comprises an upper surface, a lower surface, a front portion defining a front surface of the block, a rear portion, and an intermediate portion extending between and interconnecting the front portion and the rear portion. The intermediate portion defines a minimum spacing D3 measured from an outer side surface of the intermediate portion to another, opposing outer side surface of the intermediate portion. The rear portion comprises a first tail section and a second tail section positioned on opposite sides of a first imaginary line extending from the front portion to the rear portion and bisecting the block, wherein each of the first and second tail sections comprises a forward facing first surface and an opposing rearward facing second surface. First and second protrusions can be formed on the upper surface of the block, wherein the first and second protrusions are located on opposite sides of the first imaginary line and are closer to the second surfaces of the tail sections than they are to the front surface of the block. An outboard side of the first protrusion is spaced a distance D4 from a second imaginary line that is parallel to the first imaginary line and intersects a lateral most location of a first side of the block. An outboard side of the second protrusion is spaced the distance D4 from a third imaginary line that is parallel to the first imaginary line and intersects a lateral most location of a second side of the block, and D3 is less than twice the distance D4.

In some examples, the first and second protrusions are offset from the second surfaces of the tail sections a first distance and offset from the front surface a second distance, wherein the second distance is greater than the first distance.

In some examples, the intermediate portion comprises first and second leg portions extending from the front portion to the rear portion, wherein first and second leg portions are separated laterally from each other by a void in the block.

In some examples, the first leg portion is connected to the first tail section and the second leg portion is connected to the second tail section.

In some examples, each tail section has a length that is perpendicular to the first imaginary line.

In some examples, the first leg portion comprises a concave side surface portion that intersects the forward facing first surface of the first tail section and the second leg portion comprises a concave side surface portion that intersects the forward facing first surface of the second tail section.

In some examples, the front surface of the block is parallel to the rearward facing second surfaces of the tail sections.

In some examples, the forward facing first surfaces of the tail sections are parallel to the rearward facing second surfaces of the tail sections.

In some examples, the first protrusion is formed on the first tail section and the second protrusion is formed on the second tail section.

In some examples, a wall block comprises an upper surface, a lower surface, a front portion defining a front surface of the block, a rear portion, and an intermediate portion extending between and interconnecting the front portion and the rear portion. The intermediate portion comprises first and second leg portions extending from the front portion to the rear portion, wherein the first and second leg portions are separated laterally from each other by a void in the block, and wherein the first and second leg portions define a minimum spacing D3 measured from an outer side surface of the first leg portion to an outer side surface of the second leg portion. The rear portion comprises a first tail section and a second tail section positioned on opposite sides of a first imaginary line extending from the front portion to the rear portion and bisecting the block, wherein each of the first and second tail sections comprises a forward facing first surface and an opposing rearward facing second surface. The first leg portion is connected to the first tail section and the second leg portion is connected to the second tail section. First and second protrusions are formed on the upper surface of the block, wherein the first and second protrusions are located on opposite sides of the first imaginary line and rearward of a second imaginary line, wherein the second imaginary line extends laterally of the block and is equidistant from the front surface and the second surfaces of the tail sections. An outboard side of the first protrusion is spaced a distance D4 from a third imaginary line that is parallel to the first imaginary line and intersects a lateral most location of a first side of the block. An outboard side of the second protrusion is spaced the distance D4 from a fourth imaginary line that is parallel to the first imaginary line and intersects a lateral most location of a second side of the block, wherein D3 is less than twice the distance D4.

In some examples, the forward facing first surfaces of the first and second tail sections are parallel to the front surface of the block.

In some examples, the rearward facing second surfaces of the first and second tail sections are parallel to the front surface of the block.

In some examples, each tail section has a length that is perpendicular to the first imaginary line.

In some examples, the first leg portion comprises a concave side surface portion that intersects the forward facing first surface of the first tail section and the second leg portion comprises a concave side surface portion that intersects the forward facing first surface of the second tail section.

In some examples, the first protrusion is formed on the first tail section and the second protrusion is formed on the second tail section.

In some examples, the first and second protrusions are offset from the second surfaces of the tail sections a first distance and offset from the front surface a second distance, wherein the second distance is greater than the first distance.

In some examples, a wall comprises at least a first lower course and a second upper course overlying the first course, wherein each course comprises a plurality of first blocks. Each first block comprises an upper surface, a lower surface, a front portion defining a front surface of the block, a rear portion, and an intermediate portion extending between and interconnecting the front portion and the rear portion. The rear portion comprises a first tail section and a second tail section positioned on opposite sides of a first imaginary line extending from the front portion to the rear portion and bisecting the block, wherein each of the first and second tail sections comprises a forward facing first surface and an opposing rearward facing second surface. Each first block further comprises first and second protrusions formed on the upper surface of the block, wherein the first and second protrusions are located on opposite sides of the first imaginary line and are closer to the second surfaces of the tail sections than they are to the front surface of the block. The protrusions of the first blocks in the first course engage respective forward facing first surfaces of tail sections of respective first blocks in the second course such that the first blocks in the second course are set back relative to the first blocks in the first course.

In some examples, the wall comprises a straight section.

In some examples, the wall comprises a concave curved section.

In some examples, the wall comprises a convex curved section.

In some examples, the intermediate portion of a first block in the second course is positioned between a protrusion of a first block in the first course and a protrusion of another first block in the first course.

DETAILED DESCRIPTION

General Considerations

Figure 1:
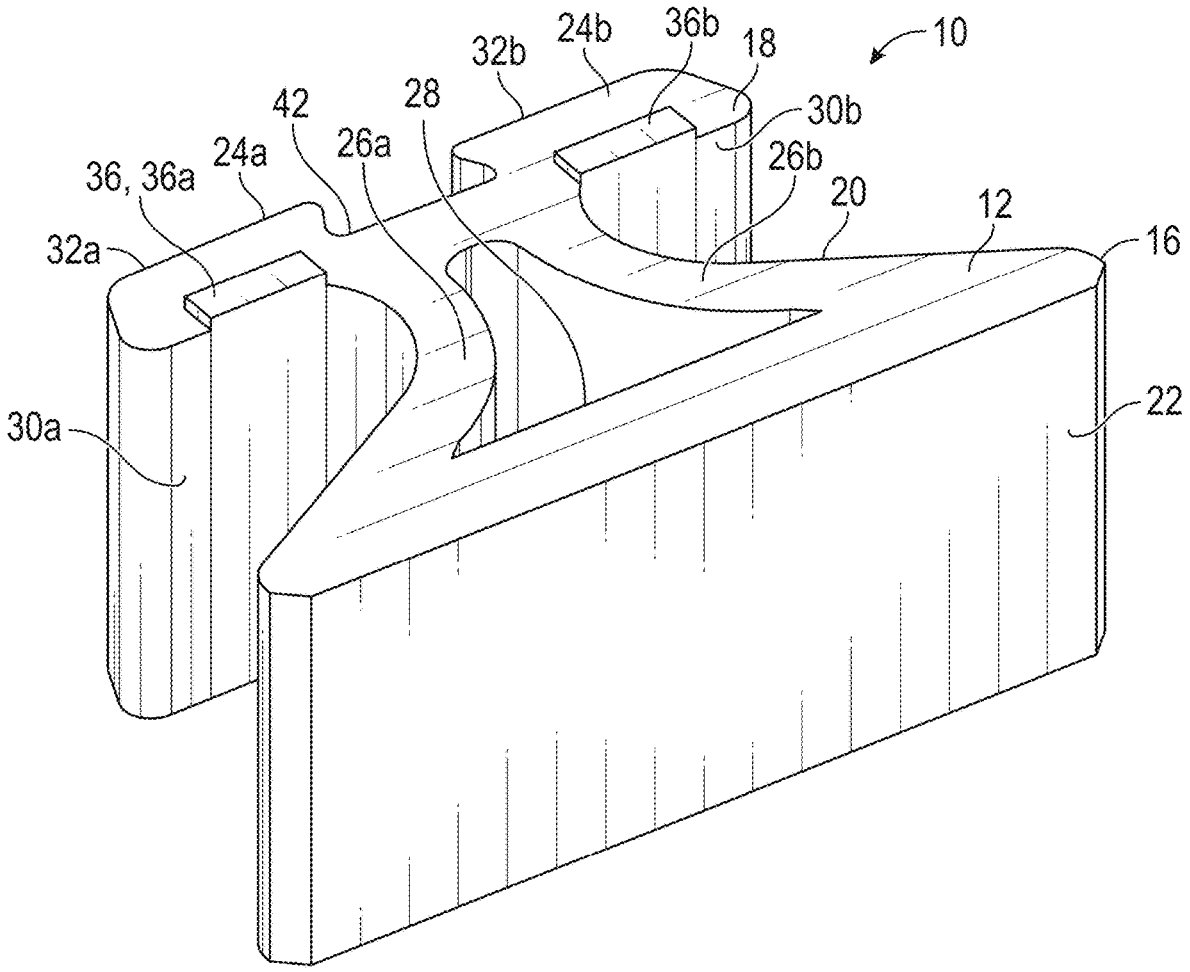
FIG. 1 is a perspective view of a wall block, according to one example.
Figure 2:
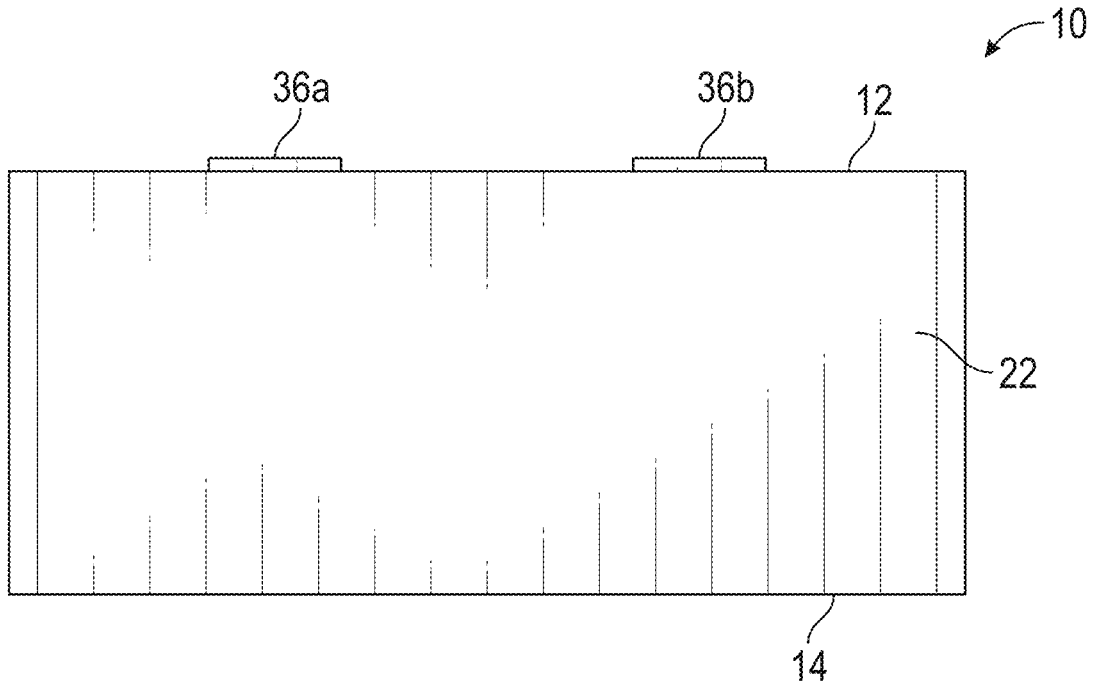
FIG. 2 is a front view of the wall block of FIG. 1.
Figure 3:
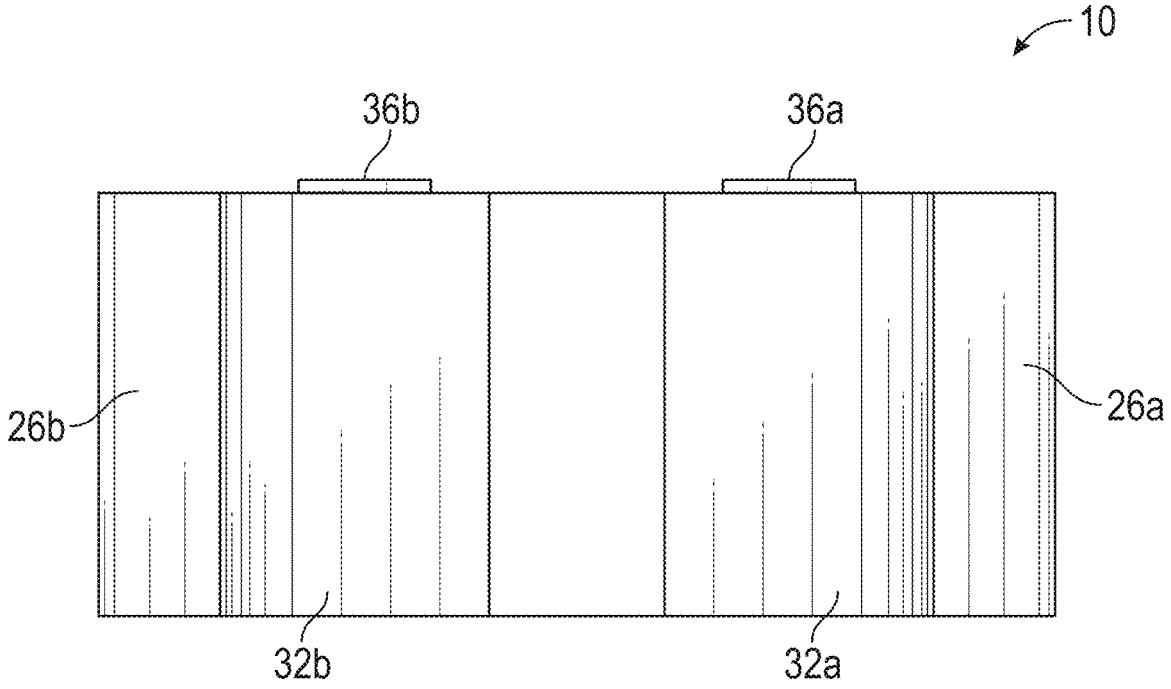
FIG. 3 is a rear view of the wall block of FIG. 1.
Figure 4:
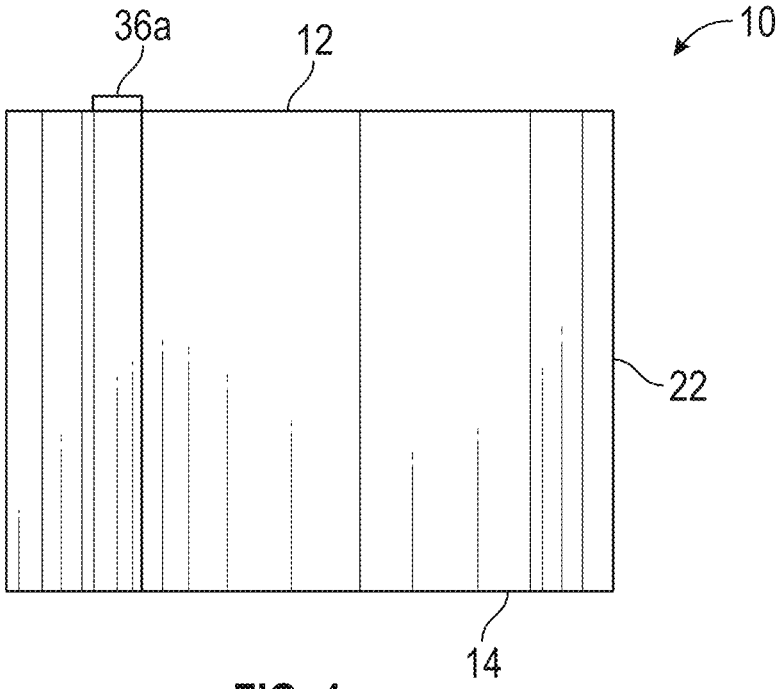
FIG. 4 is a right side elevation view of the wall block of FIG. 1.
Figure 5:
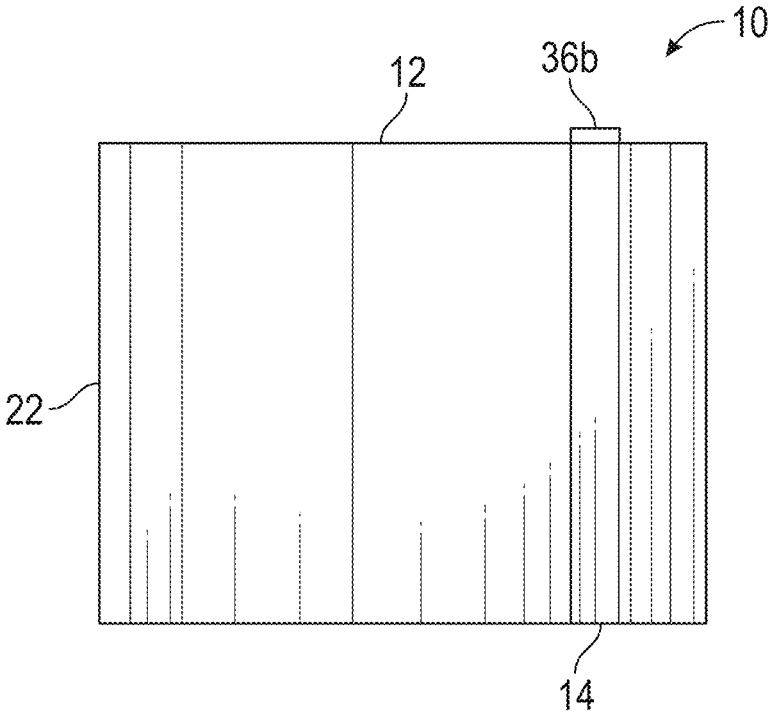
FIG. 5 is left side elevation view of the wall block of FIG. 1.

For purposes of this description, certain aspects, advantages, and novel features of examples of this disclosure are described herein. The present disclosure is directed toward all novel and nonobvious features and aspects of the various disclosed examples, alone and in various combinations and sub-combinations with one another. The methods, apparatus, and systems are not limited to any specific aspect or feature or combination thereof, nor do the disclosed examples require that any one or more specific advantages be present or problems be solved.

Although the operations of some of the disclosed examples are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "provide" or "achieve" to describe the disclosed methods. These terms are high-level abstractions of the actual operations that are performed. The actual operations that correspond to these terms may vary depending on the particular implementation and are readily discernible by one of ordinary skill in the art.

As used in this application and in the claims, the singular forms "a," "an," and "the" include the plural forms unless the context clearly dictates otherwise. Additionally, the term "includes" means "comprises." Further, the term "coupled" generally means physically, mechanically, chemically, magnetically, and/or electrically coupled or linked and does not exclude the presence of intermediate elements between the coupled or associated items absent specific contrary language.

Overview of the Disclosed Technology

In the following description, "upper" and "lower" refer to the placement of a block in a structure, such as a retaining wall, fence, or column. The lower, or bottom, surface of a block is placed such that it faces the ground. In a wall, one row of blocks is laid down, forming a lowermost course or tier. An upper course or tier is formed on top of this lower course by positioning the lower surface of one block on the upper surface of another block. Additional courses may be added until a desired height of the wall is achieved. Typically, earth is retained behind a retaining wall so that only a front surface of the wall is exposed. A free-standing wall (i.e., one which does not serve to retain earth) having two exposed surfaces may be referred to as a "fence." Any of the walls disclosed herein can be retaining walls or free-standing walls. Moreover, the blocks disclosed herein also can be used to construct columns.

As used herein, the "lateral" direction with respect to a block is a direction extending side-to-side of the block and perpendicular to a front-to-back direction of the block.

FIGS. 1-7 show a block 10 for constructing walls, columns, or other structures, according to one example. The block 10 (as well as any and all blocks disclosed herein) can be made of concrete, using any known manufacturing techniques, such as dry-casting the block using a block-forming machine or wet-casting the block using a mold. The block 10 comprises an upper surface 12, a lower surface 14, a front portion 16, a rear portion 18, and an intermediate portion 20 extending between and interconnecting the front portion 16 and the rear portion 18. The front portion 16 defines a front surface 22 of the block 10.

The rear portion 18 comprises a first tail section 24*a* and a second tail section 24*b*. The intermediate portion 20 can comprise a first leg portion 26*a* and a second leg portion 26*b*. The first leg portion 26*a* can extend between and interconnect the front portion 16 and the first tail section 24*a*. The second leg portion 26*b* can extend between and interconnect the front portion 16 and the second tail section 24*b*. The leg portions 26*a*, 26*b* can be spaced apart in a lateral direction of the block (side-to-side) by a void 28 that extends the height of the block from the upper surface 12 to the lower surface 14.

Figure 6:
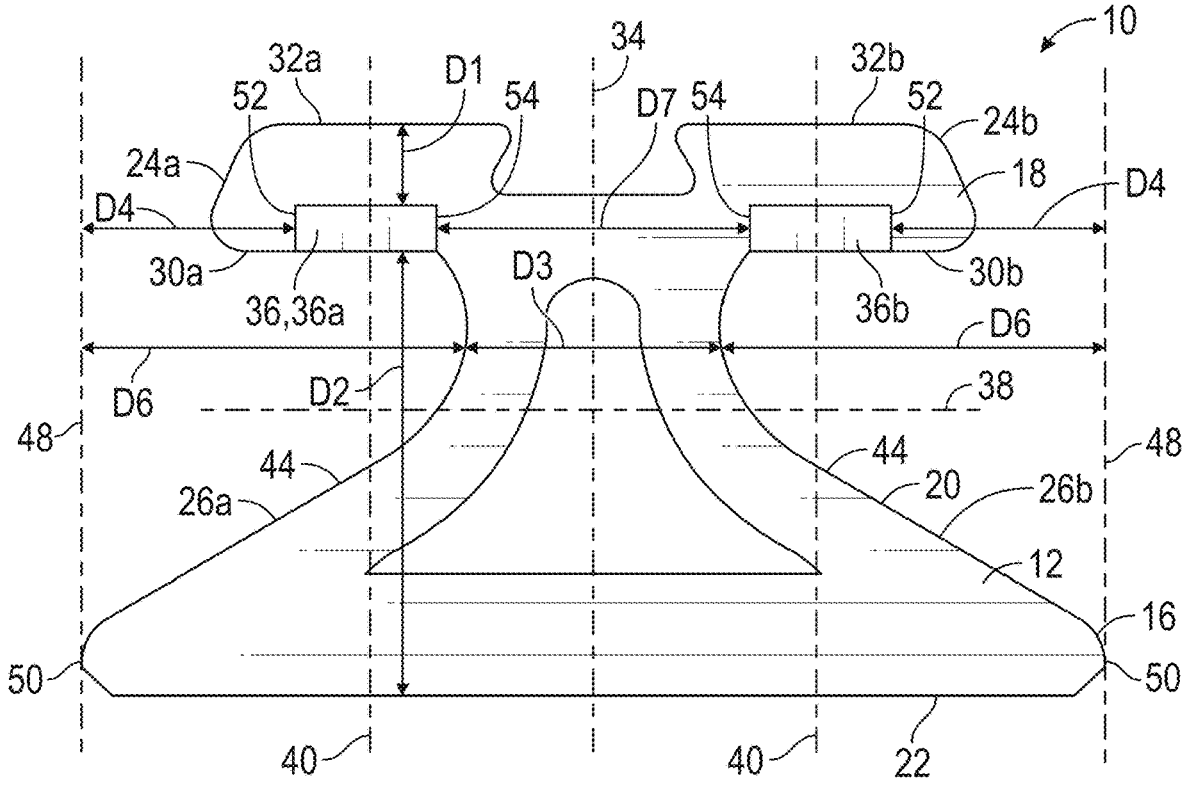
FIG. 6 is a top plan view of the wall block of FIG. 1.

The first tail section 24*a* defines a forward facing first surface 30*a* and a rearward facing a second surface 32*a*. The second tail section 24*b* defines a forward facing first surface 30*b* and rearward facing second surface 32*b*. As best shown in FIG. 6, the tail sections 24*a*, 24*b* are on opposite sides of a first imaginary line 34 that extends from the front portion 16 to the rear portion 18 and bisects the block 10. The second surfaces 32*a*, 32*b* can define a rear surface of the block. As shown, in some examples, the first surfaces 30*a*, 30*b* can be parallel to the second surfaces 32*a*, 32*b*, and the first and second surfaces 30*a*, 30*b*, 32*a*, 32*b* can be perpendicular to the first imaginary line 34. As further shown, in some examples, the front surface 22 of the block can be parallel to the first surfaces 30*a*, 30*b* and the second surfaces 32*a*, 32*b* and perpendicular to the first imaginary line 34.

The block 10 can further comprise one or more connection features, such as in the form of one or more nubs, projections, or protrusions 36 formed on and projecting upwardly from the upper surface 12 of the block. Each protrusion 36 is configured to engage a surface of an overlying block 10 in a wall for purposes of aligning blocks when constructing a wall and/or better resisting forces exerted against the wall. The protrusions 36 desirably are integral protrusions, meaning that they are formed as part of the overall block during the molding process.

In the illustrated example, the block 10 includes a first protrusion 36*a* and a second protrusion 36*b* positioned on opposite sides of and desirably spaced equidistantly from the first imaginary line 34. In some examples, the protrusions 36*a*, 36*b* can be spaced different distances from the first imaginary line 34. The first and second protrusions 36*a*, 36*b* can, in some examples, be positioned rearward of a second imaginary line 38 that is perpendicular to the first imaginary line 34, extends laterally of the block 10 (side-to-side), and is equidistant from the front surface 22 and the rear surface defined by the second surfaces 32*a*, 32*b* of the tail sections 24*a*, 24*b*. For example, as shown, the first and second protrusions 36*a*, 36*b* can be formed on the first and second tail sections 24*a*, 24*b*, respectively. In some examples, as shown, the first and second protrusions 36*a*, 36*b* can be offset from the rear of the block (the second surfaces 32*a*, 32*b*) a first distance D1 and offset from the front of the block (the front surface 22) a second distance D2, wherein D2 is greater than D1. The distance D1 can be selected to define a desired setback or batter for vertically adjacent courses in a wall.

Figure 7:
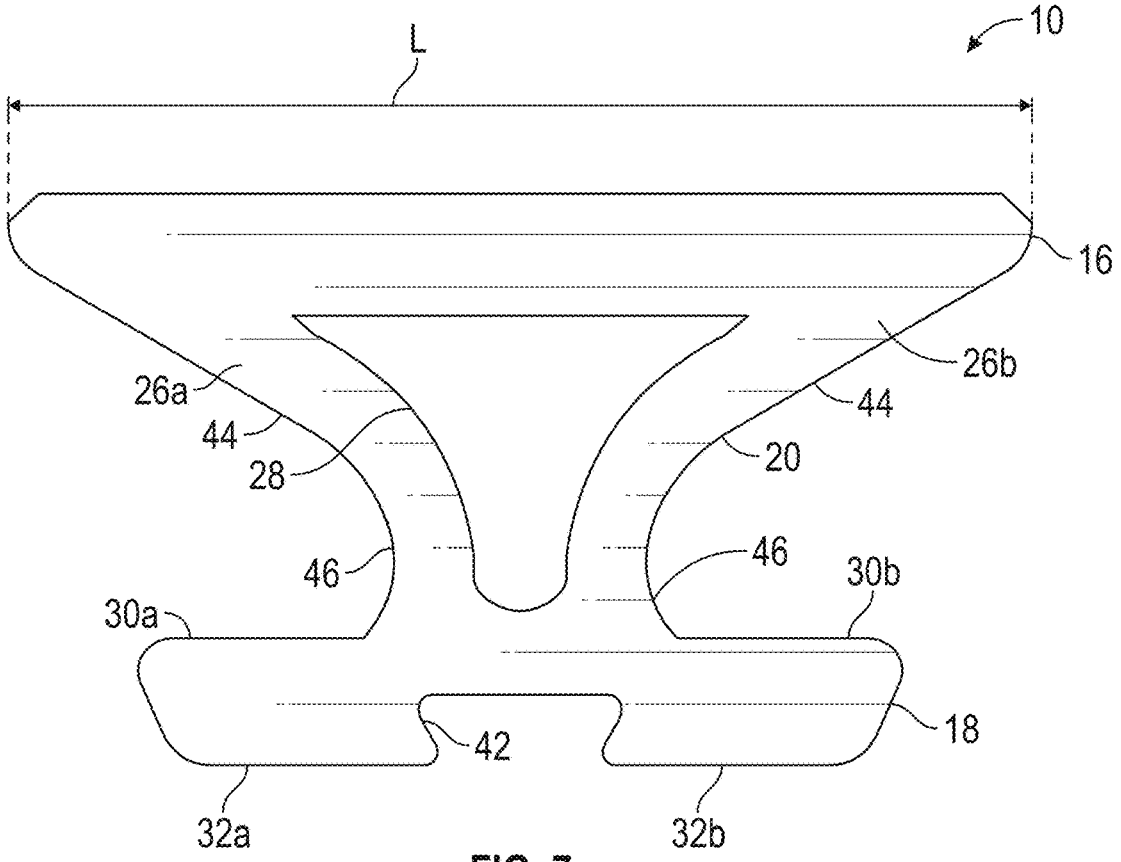
FIG. 7 is a bottom plan view of the wall block of FIG. 1.

The protrusions 36*a*, 36*b* desirably, but not necessarily, are located at "quarter points" of the block 10, meaning that each protrusion 36*a*, 36*b* is located on an imaginary line 40 that is spaced laterally from the first imaginary line 34 a distance equal to one quarter of the overall length L of the block. As shown in FIG. 7, the overall length L of the illustrated block 10 is the length of the front portion 16. In some examples, each protrusion 36*a*, 36*b* is centered on a respective imaginary line 40. Positioning the protrusions 36*a*, 36 on the quarter points of the block can promote engagement of the protrusions 36*a*, 36*b* with corresponding surfaces of blocks in an overlying course when forming curved walls, as further described below.

As best shown in FIG. 6, each tail section 24*a*, 24*b* can have length that extends perpendicular to the first imaginary line 34.

The rear portion 18 optionally can be formed with a female connection feature, such as in the form of a dovetail shaped groove 42 extending at least partially the height of the block, and in some examples, the full height of the block. The groove 42 is sized and shaped to receive a correspondingly shaped connection feature of a trunk block (e.g., trunk block 900), which when connected to the block, forms a block assembly having an increased depth for greater stability for constructing relatively tall walls. However, it should be understood that the block 10 can be formed without the groove 42 if such trunk blocks are not required for the wall under construction. Moreover, other blocks disclosed herein are shown as having a dovetail shaped groove or similar feature for connection to a trunk block. It should be understood that those blocks also can be formed without the groove.

As best shown in FIG. 7, each leg portion 26*a*, 26*b* defines an outer side surface 44 that extends from the front portion 16 to the rear portion 18. Each side surface 44 intersects a corresponding first surface 30*a*, 30*b* of one of the tail sections. In some examples, each side surface 44 is formed with a concave curved section 46 that intersects a corresponding first surface 30*a*, 30*b* of one the tail sections.

Figure 8A:
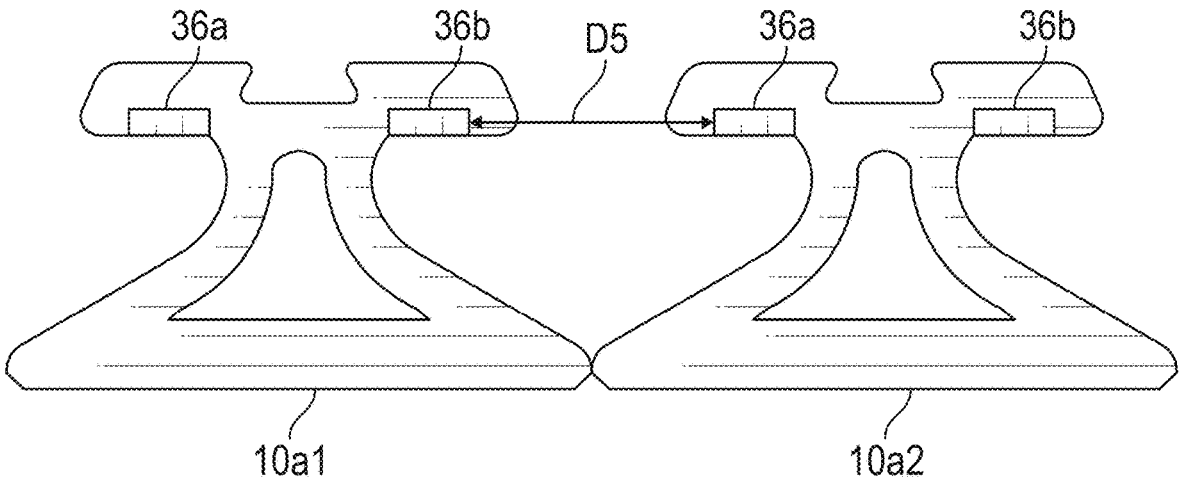
FIG. 8A is a top plan view of two blocks of the type shown in FIG. 1 placed side-by-side for forming a course of blocks.
Figure 8B:
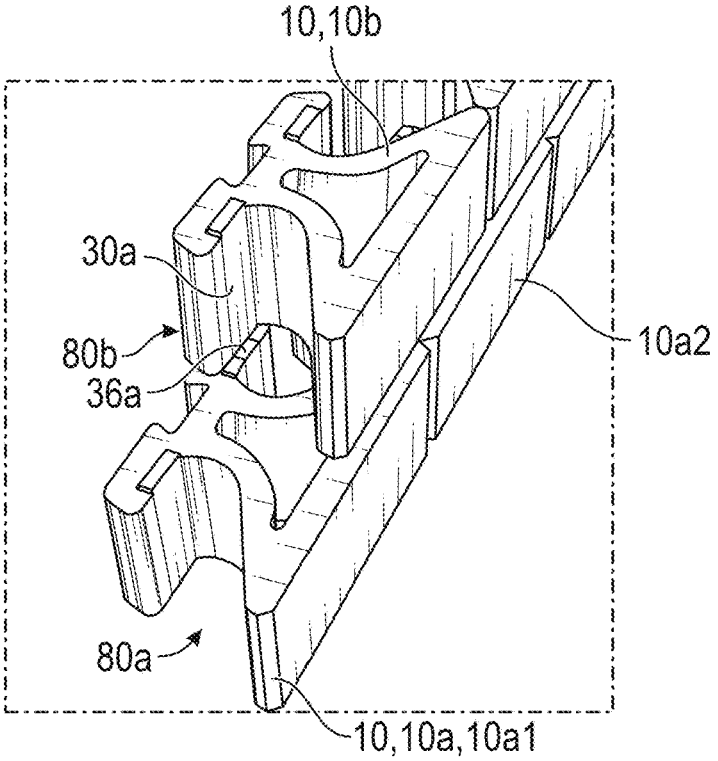
FIG. 8B is a perspective view of a portion of a wall constructed from blocks of the type shown in FIG. 1.
Figure 9:
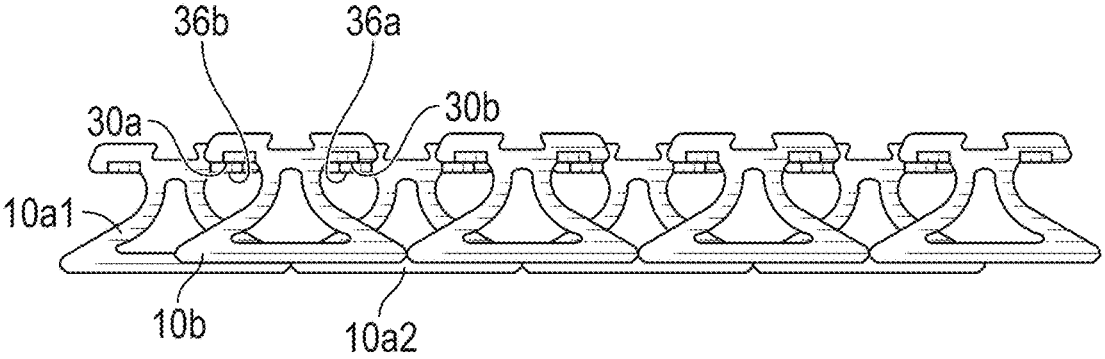
FIG. 9 is a top plan view of a wall constructed from blocks of the type shown in FIG. 1.
Figure 10:
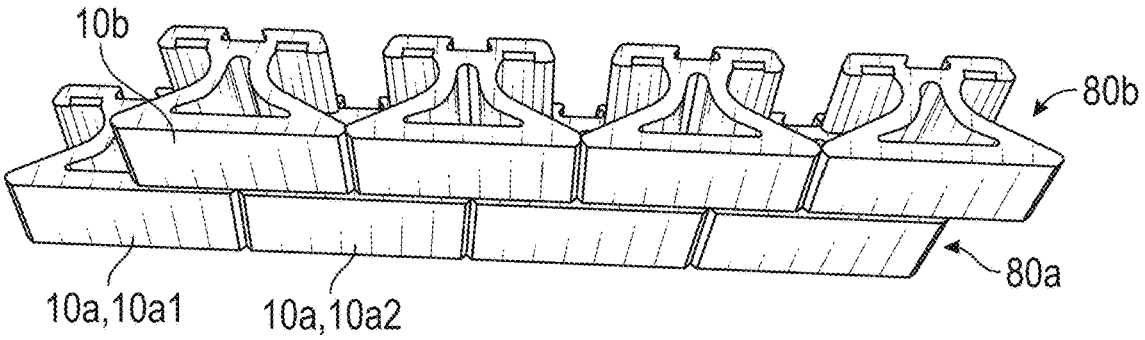
FIG. 10 is a perspective view of the wall of FIG. 9.

The positioning of the protrusions 36*a*, 36*b* and the spacing between the leg portions 26*a*, 26*b* are selected to allow stacking of blocks on top of each other in a running bond pattern in a wall without the protrusions 36*a*, 36*b* contacting the lower surface of an overlying block and interfering with the stacking of blocks. Explaining further, the leg portions 26*a*, 26*b* have a minimum spacing D3 measured from an outer side surface 44 of the first leg portion 26*a* to the outer side surface 44 of the second leg portion 26*b*. An outboard side 52 (the side facing away from the line 34) of the protrusion 36*a* is spaced a distance D4 from an adjacent corresponding imaginary line 48 that is parallel to the imaginary lines 34, 40 and intersects a lateral most location 50 on the same side of the block. Similarly, an outboard side 52 of the protrusion 36*b* is spaced the distance D4 from an adjacent corresponding imaginary line 48 that is parallel to the imaginary lines 34, 40 and intersects a lateral most location 50 on the same side of the block. The distance measured from one imaginary line 48 to the other imaginary line 48 defines the overall length of the block (which corresponds to the length L of the front portion 16 in the illustrated example). As shown in FIG. 8A, when two blocks 10*a*1 and 10*b*2 are placed side by side in the same course in a straight wall, a distance D5 is defined as the distance measured from a protrusion 36*b* of one block 10*a*1 to the closest protrusion 36*a* of an adjacent block 10*a*2. In a straight wall, the distance D5 is equal to twice the distance D4 (assuming the two blocks 10*a*1 and 10*a*2 are positioned in contact with each other). The distance D3 (the minimum width of the block measured at the leg portions 26*a*, 26*b*) is less than D5; stated differently, D3 is less than twice the distance D4. This allows the leg portions 26*a*, 26*b* of an overlying block 10 (not shown in FIG. 8A) to be placed between the protrusion 36*b* of the underlying block 10*a*1 and the protrusion 36*a* of the block 10*a*2, thereby allowing stacking of the overlying block on top of the blocks 10*a*1, 10*a*2.

Referring to FIG. 6, the outer side surface 44 of the first leg portion 26*a* is spaced a distance D6 from a corresponding imaginary line 48, where D6 is measured along a line that extends laterally across the block at the minimum width D3. Similarly, the outer side surface 44 of the second leg portion 26*b* is spaced the same distance D6 from a corresponding imaginary line 48, as measured along a line extends laterally across the block at the minimum width D3. In some examples, D6 is greater than D4.

In some examples, as shown in FIG. 6, a distance D7 measured from an inboard side 54 (the side facing the line 34) of the protrusion 36*a* to an inboard side 54 of the protrusion 36*b* is equal to or greater than D3.

In some examples, the block 10 can be formed without a void 28, in which case the block does not define two spaced apart leg portions. In such examples, the distance D3 is the minimum width of the intermediate portion 20 measured from one side surface 44 of the intermediate portion 20 to the opposing side surface 44 of the intermediate portion 20.

In some examples, instead of two separate, spaced apart protrusions 36*a*, 36*b*, the block 10 can be formed with a single protrusion on the upper surface of the block that extends laterally of the block from one side of the imaginary line 34 to the other side of the imaginary line 34. For example, in some such examples, the single protrusion can be formed on the upper surface of the rear portion 18 and can extend continuously from the location of the outboard side 52 of the protrusion 36*a* to the location of the outboard side 52 of the protrusion 36*b*. Such a block can be used in the same manner as the block 10 with two protrusions 36*a*, 36*b* for constructing straight walls and curved walls as depicted in FIGS. 8B-12.

Advantageously, the tail sections 24*a*, 24*b* are shaped to allow a worker to use the tail sections as hand holds for lifting and carrying a block at a job site. For example, when the block is positioned face down (the front surface 22 is facing the ground), the block can be lifted by placing the hands around the sides of the tail sections with the fingers underneath the first surfaces 30*a*, 30*b*. The tail sections are ergonomically shaped with curved outside corners to facilitate grasping of the tail sections with the hands.

FIGS. 8B-10 illustrate a wall comprising a first course 80*a* of blocks 10*a* and a second course 80*b* of blocks 10*b*. Additional courses may be added to achieve the desired height of the wall. When placing the blocks 10*b* to form the second course 80*b*, the tail sections 24*a*, 24*b* of blocks 10*b* are positioned behind the protrusions 36*a*, 36*b* of blocks 10*a* in the first course 80*a* such that a protrusion 36*a*, 36*b* of a block 10*a* can engage a first surface 30*a*, 30*b* of an overlying block 10*b*. The blocks 10*b* can be positioned relative to the blocks 10*a* in a running bond pattern such that each block 10*b* in the second course 80*b* can overlap or straddle two adjacent blocks 10*a* in the first course 80*a*. For example, referring to FIG. 9, the protrusion 36*b* of a first block 10*a*1 engages the first surface 30*a* of a bock 10*b* and the protrusion 36*a* of a second block 10*a*2 engages the first surface 30*b* of the same block 10*b*. The engagement of the tail sections 24*a*, 24*b* of the blocks 10*b* in the second course 80*b* with the protrusions 36*a*, 36*b* of the blocks 10*a* in the first course 80*a* positions the blocks 10*b* to be slightly setback relative to the blocks 10*a*, producing positive batter in the wall. As discussed above, the selection of the distances D3 and D4 allow the leg portions 26*a*, 26*b* of the overlying block 10*b* to be positioned between the protrusion 36*b* of the block 10*a*1 and the protrusion 36*a* of the block 10*a*2.

In other examples, the blocks 10*a*, 10*b* can be positioned directly on top of each other (without a running bond pattern); that is, a block 10*b* can be positioned directly above a block 10*b*, with the protrusions 36*a*, 36*b* of the block 10*a* engaging the first surfaces 30*a*, 30*b* of the block 10*a*.

Figure 11:
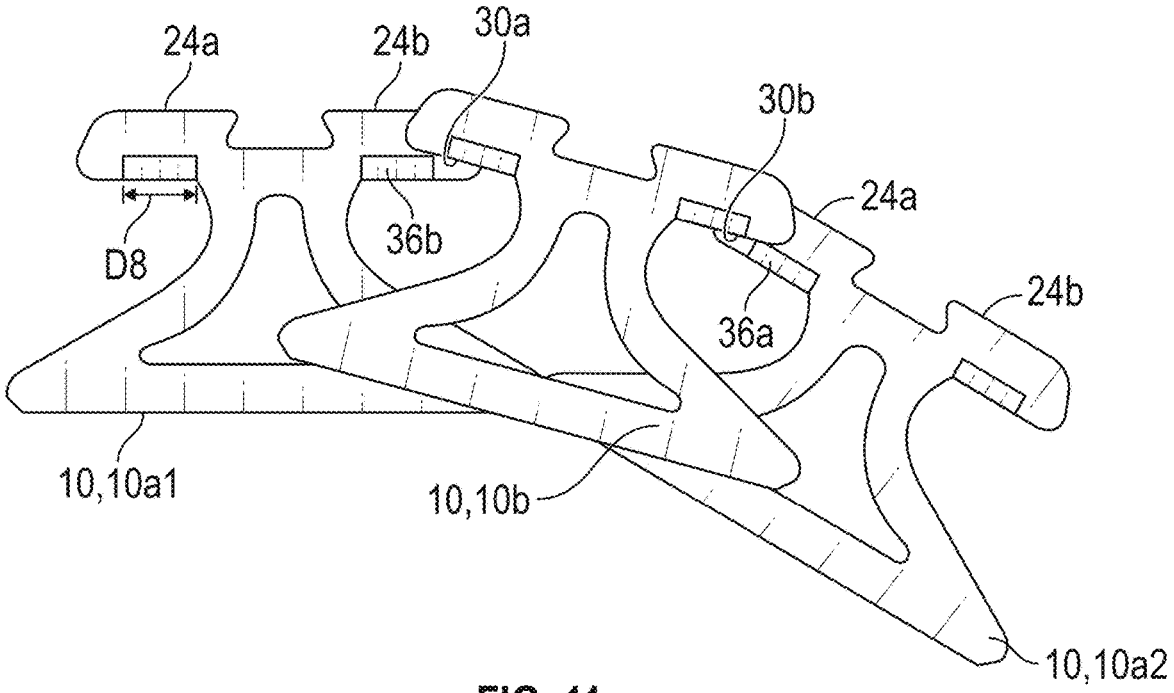
FIG. 11 is a top plan view of a portion of a concave wall constructed from blocks of the type shown in FIG. 1.

FIG. 11 illustrates the construction of a concave curved wall formed from blocks 10 of the type shown in FIGS. 1-7. When constructing a concave wall, adjacent tail sections 24*a*, 24*b* of adjacent blocks (e.g., blocks 10*a*1, 10*a*2) are moved away from each and the distance D5 between a pair of adjacent protrusions of adjacent blocks increases. The protrusions 36*a*, 36*d* have a dimension D8 (measured side to side or laterally of the block) that is selected to maintain contact with the first surfaces 30*a*, 30*b* through a concave arc.

Figure 12:
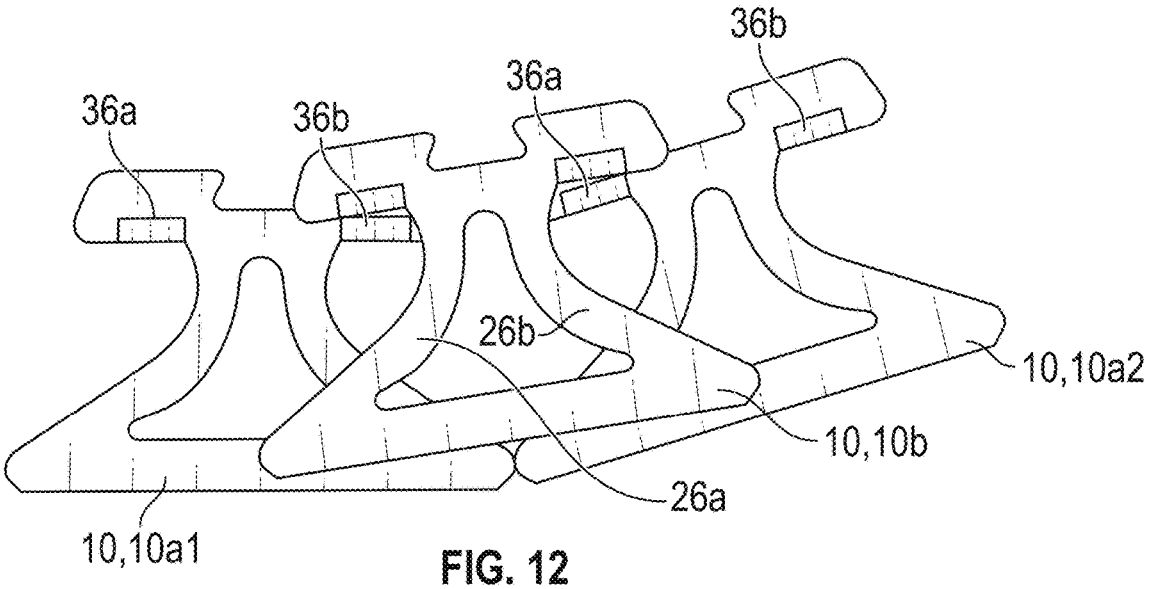
FIG. 12 is a top plan view of a portion of a convex wall constructed from blocks of the type shown in FIG. 1.

FIG. 12 illustrates the construction of a convex curved wall formed from blocks 10 of the type shown in FIGS. 1-7. As shown, even when constructing curved walls, the protrusions 36*a*, 36*b* of a lower block 10*a* are able to maintain engagement with respective first surfaces 30*a*, 30*b* of tail sections 24*a*, 24*b* of an overlying block 10*b*. Moreover, when constructing a convex wall (FIG. 12), the tail sections of adjacent blocks are brought closer together and the distance D5 between a pair of adjacent protrusion of adjacent blocks decreases. The distances D3 and D4 are selected to permit construction of a convex wall which still allows the leg portions 26*a*, 26*b* of the block 10*b* to be positioned between the protrusion 36*b* of the block 10*a*1 and the protrusion 36*a* of the block 10*a*2.

Figure 13:
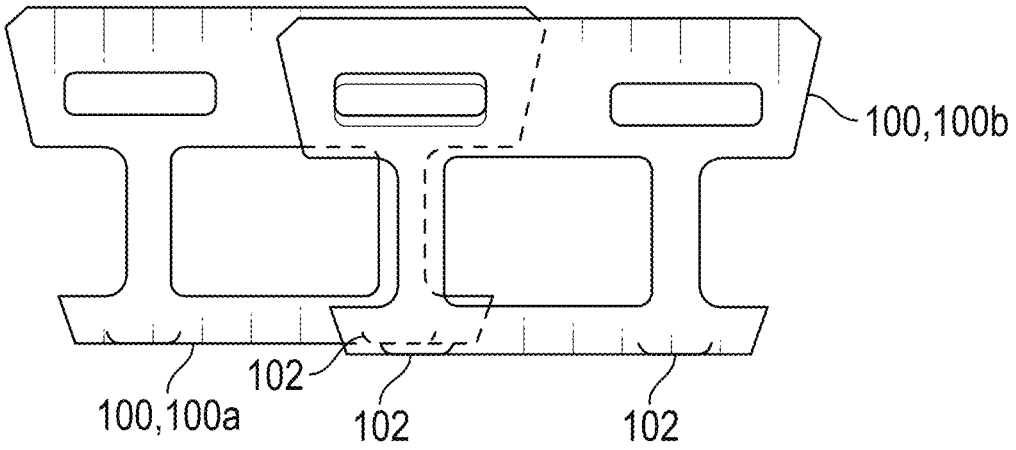
FIG. 13 is a top plan view of a wall block, according to another example, overlying another wall block of the same type in the construction of a wall.

FIG. 13 shows an example of a block 100 having projections or protrusions 102 formed on the upper surface of the block. FIG. 13 illustrates the challenge of designing a block with the protrusions 102 at or near the rear of the block. When a block 100*b* is positioned over an underlying block 10*a*, the lower surface of the block 100*b* comes into contact with a protrusion 102 of the block 100*a* below, which would prevent level stacking of a course of blocks 100*b*. The example of FIG. 13 illustrates the importance of the positioning of the protrusions and the spacing of leg portions in the design of a block, as discussed in detail above.

Figure 14:
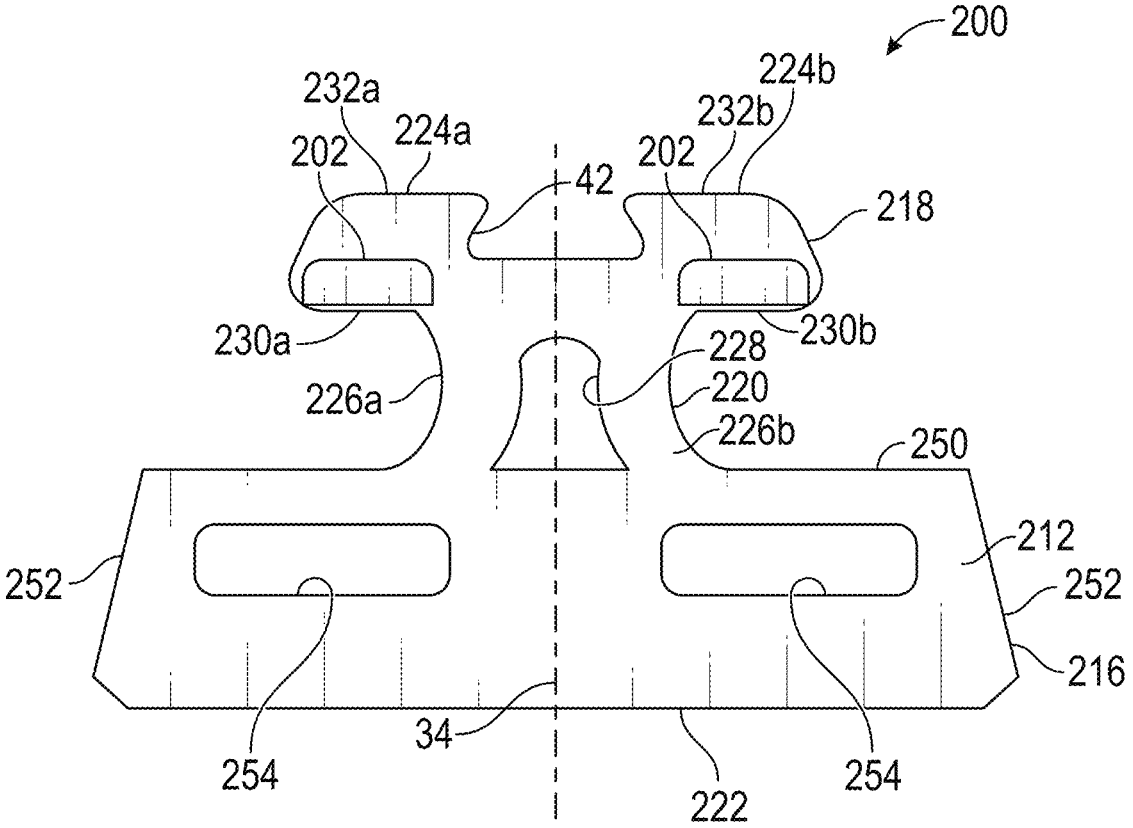
FIG. 14 is a top plan of a wall block, according to another example.
Figure 15:
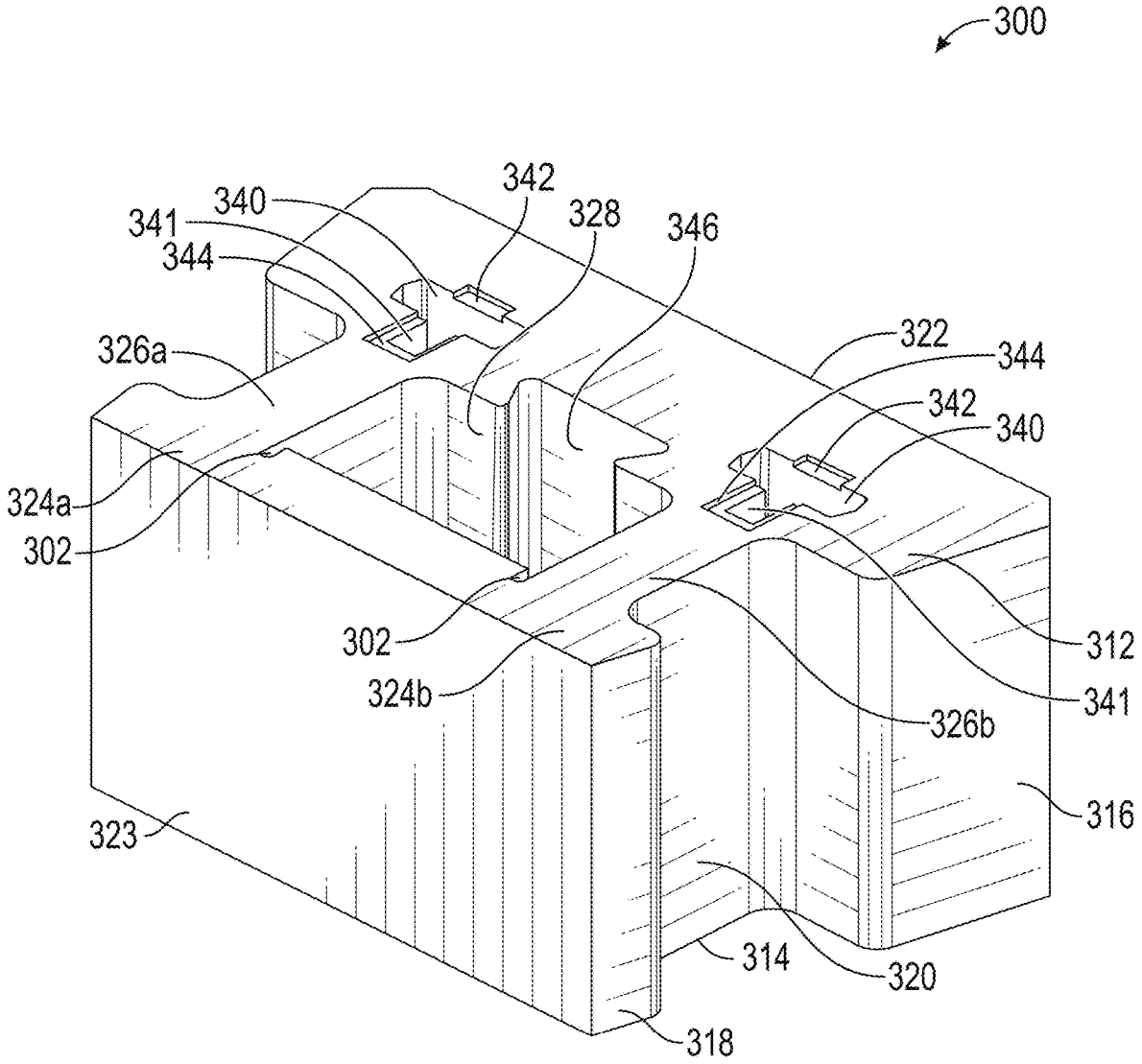
FIG. 15 is a perspective view of a wall block, according to another example.
Figure 16:
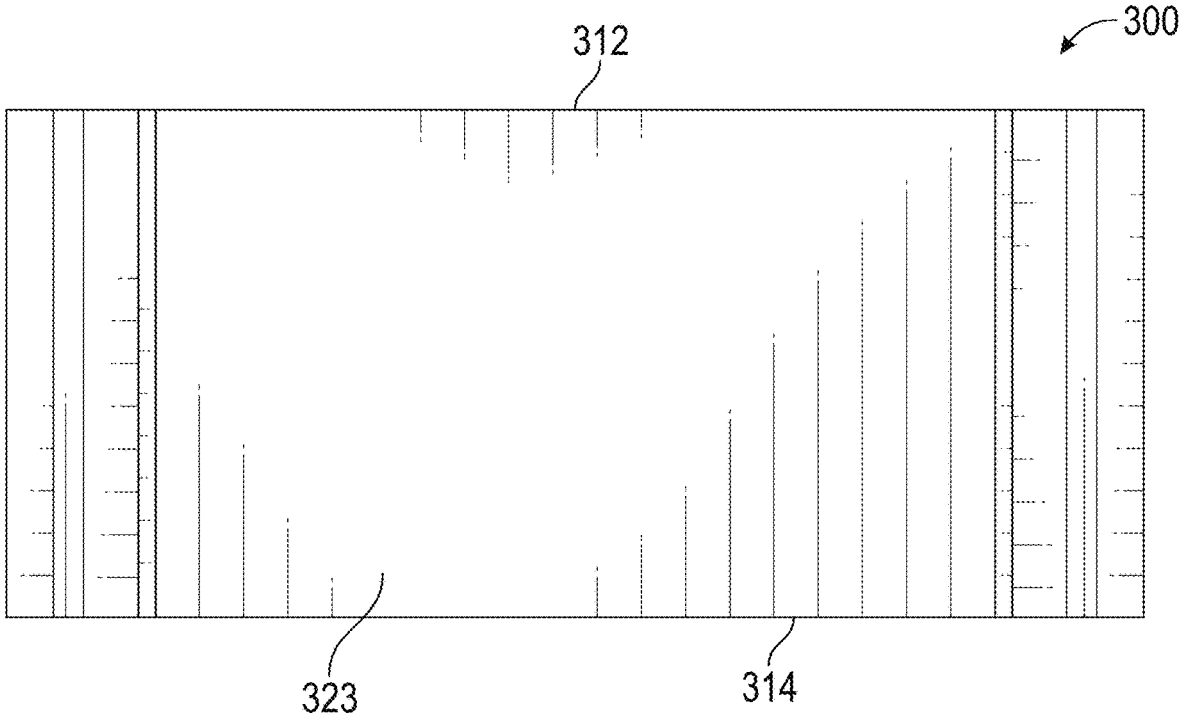
FIG. 16 is a rear view of the wall block of FIG. 15.
Figure 17:
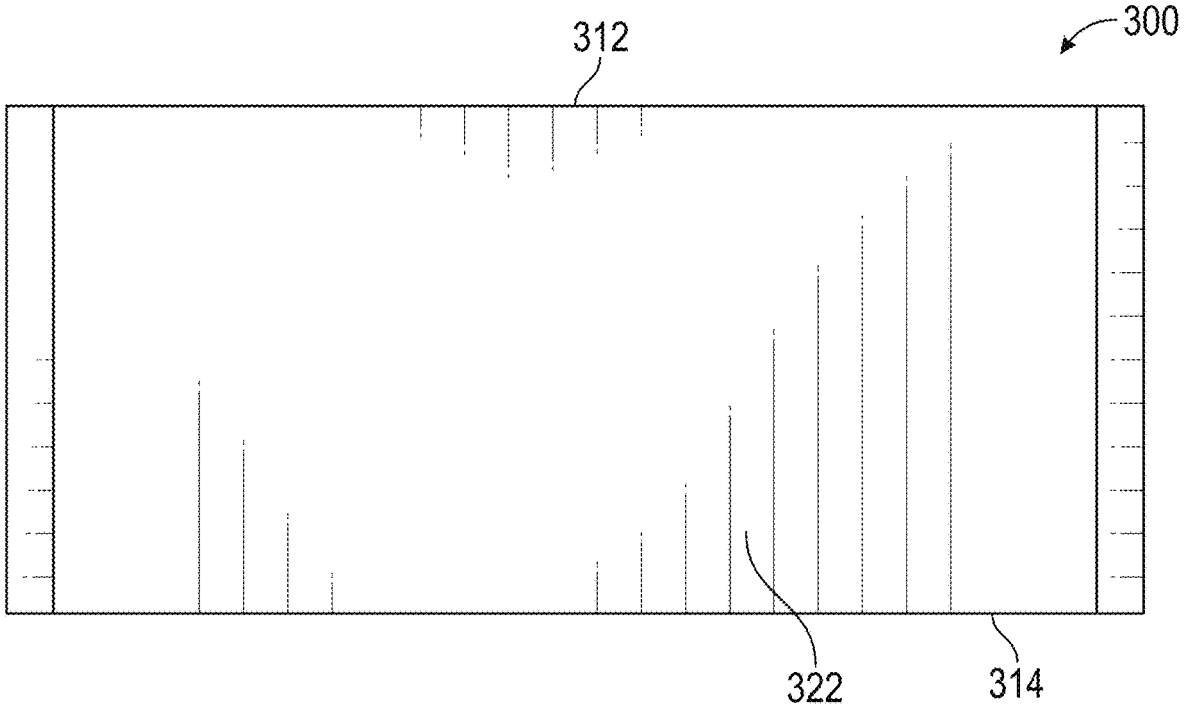
FIG. 17 is a front view of the wall block of FIG. 15.
Figure 18:
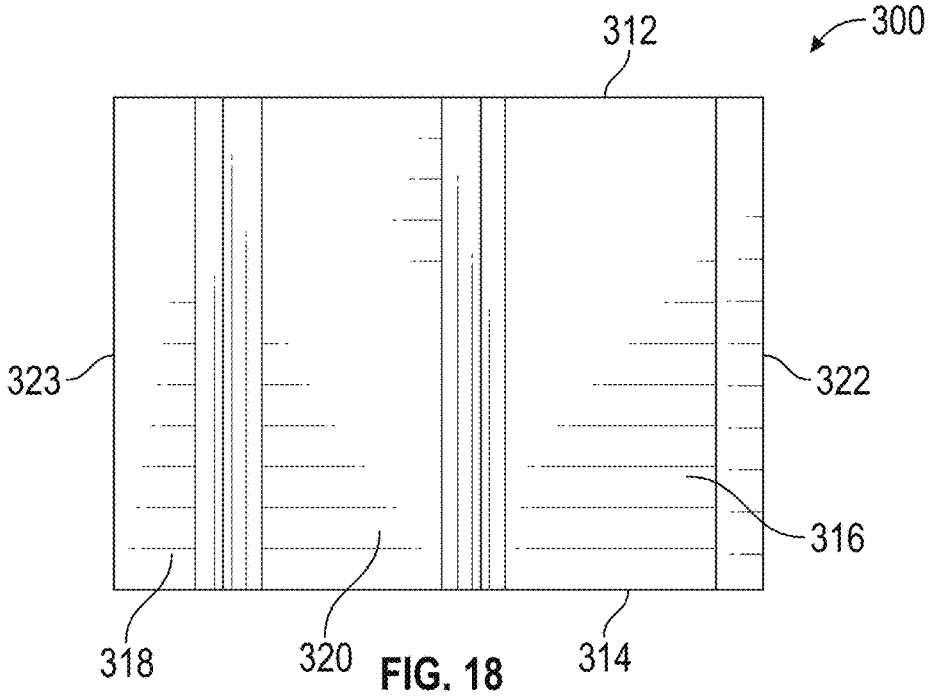
FIG. 18 is a side elevation view of the wall block of FIG. 15, the opposite side being a mirror image thereof.
Figure 19:
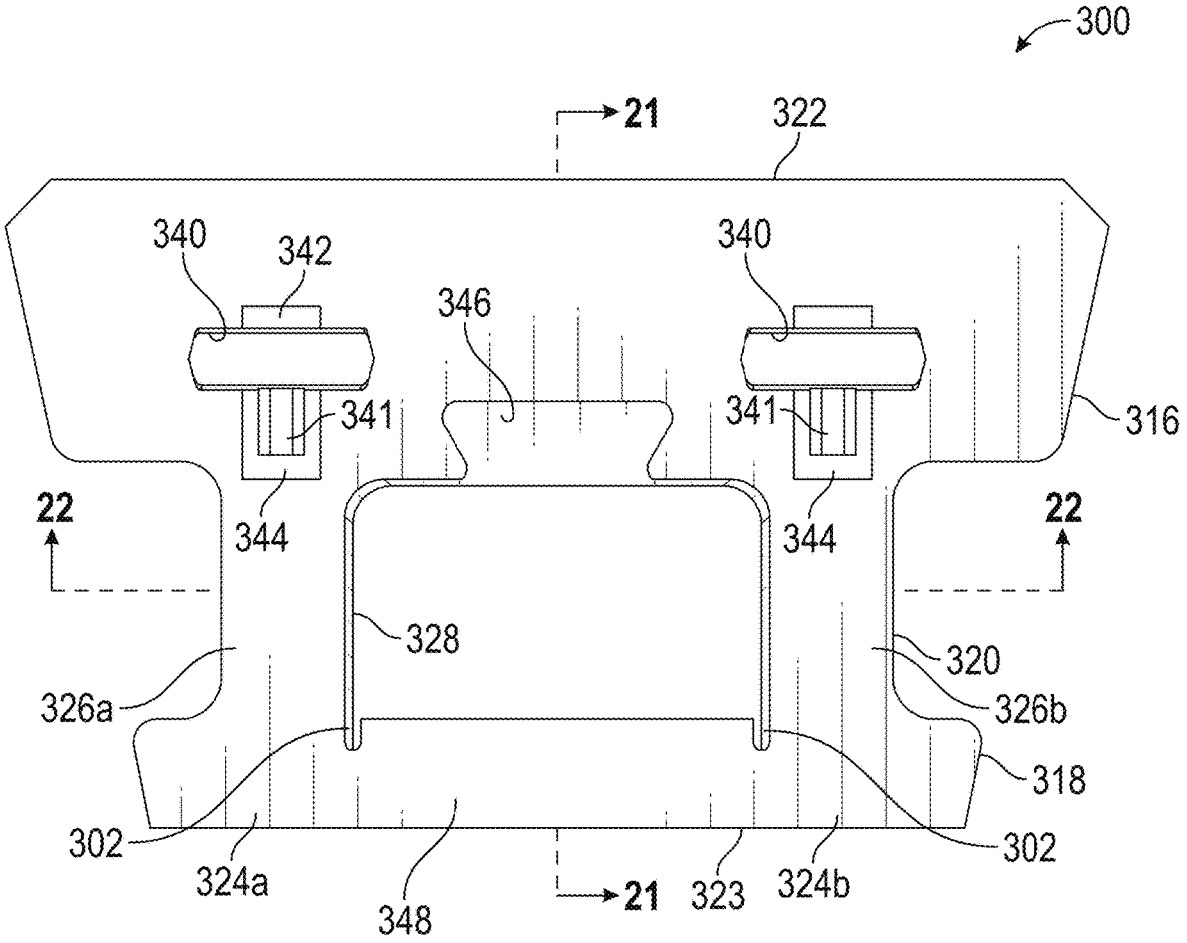
FIG. 19 is a top plan view of the wall block of FIG. 15.
Figure 20:
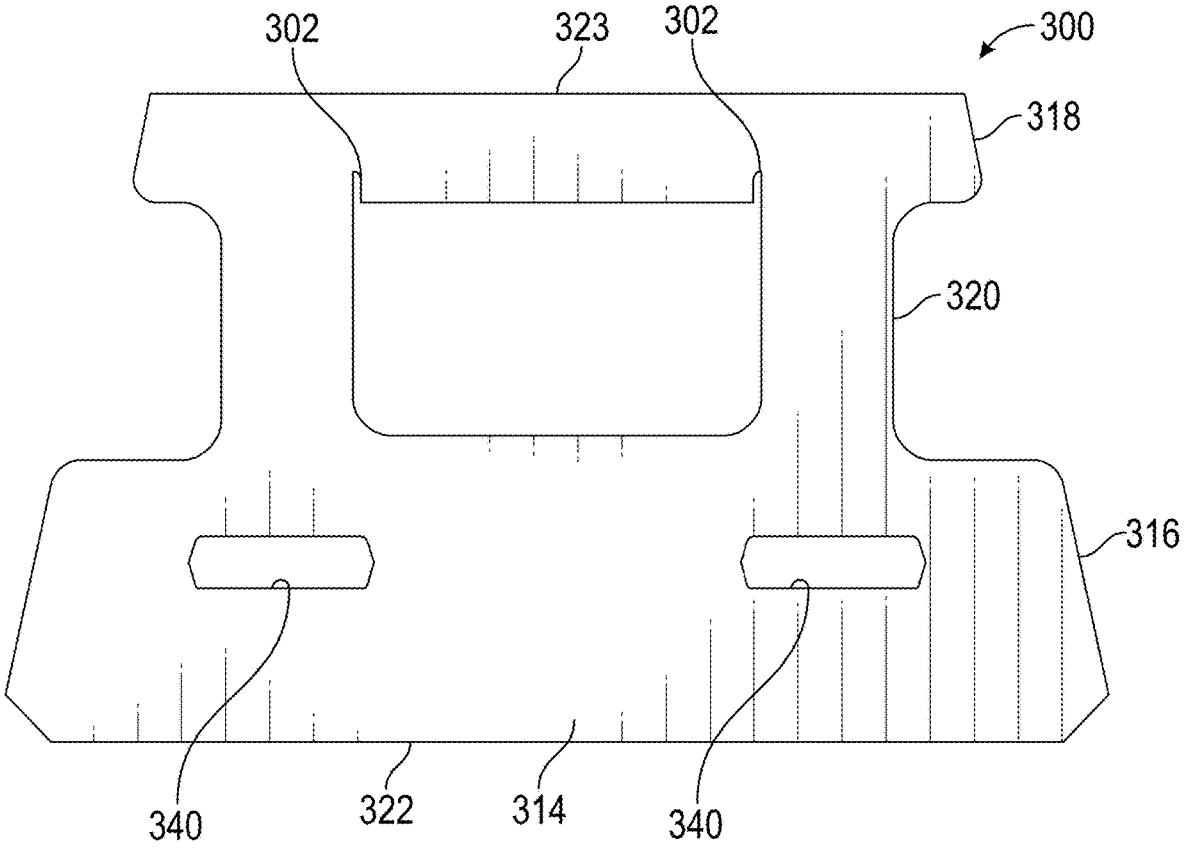
FIG. 20 is a bottom plan view of the wall block of FIG. 15.
Figure 21:
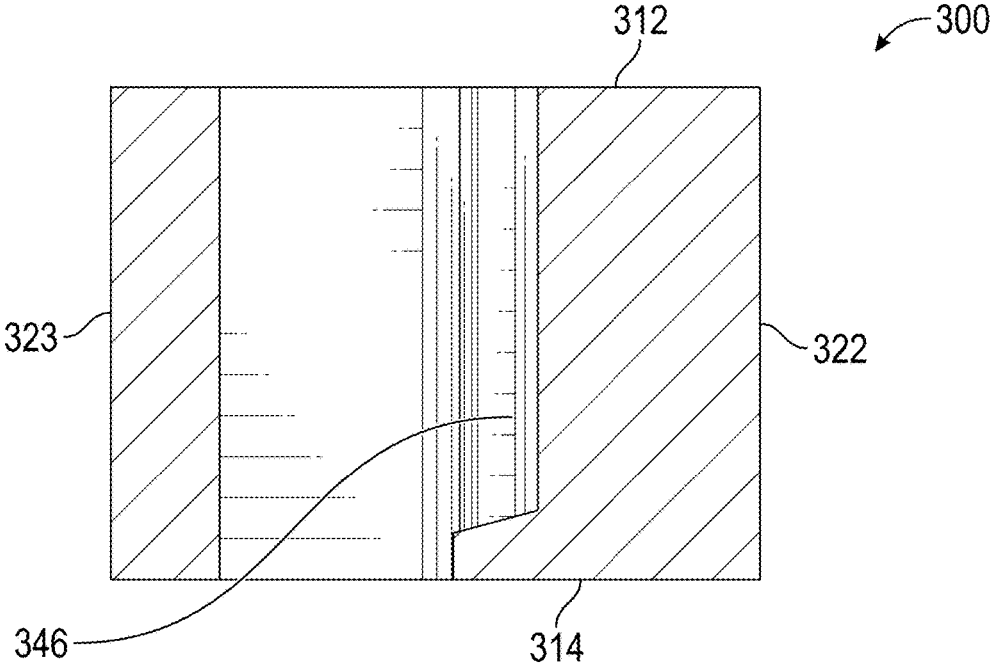
FIG. 21 is a cross-section of the wall block of FIG. 15 taken along line 21-21 of FIG. 19.
Figure 22:
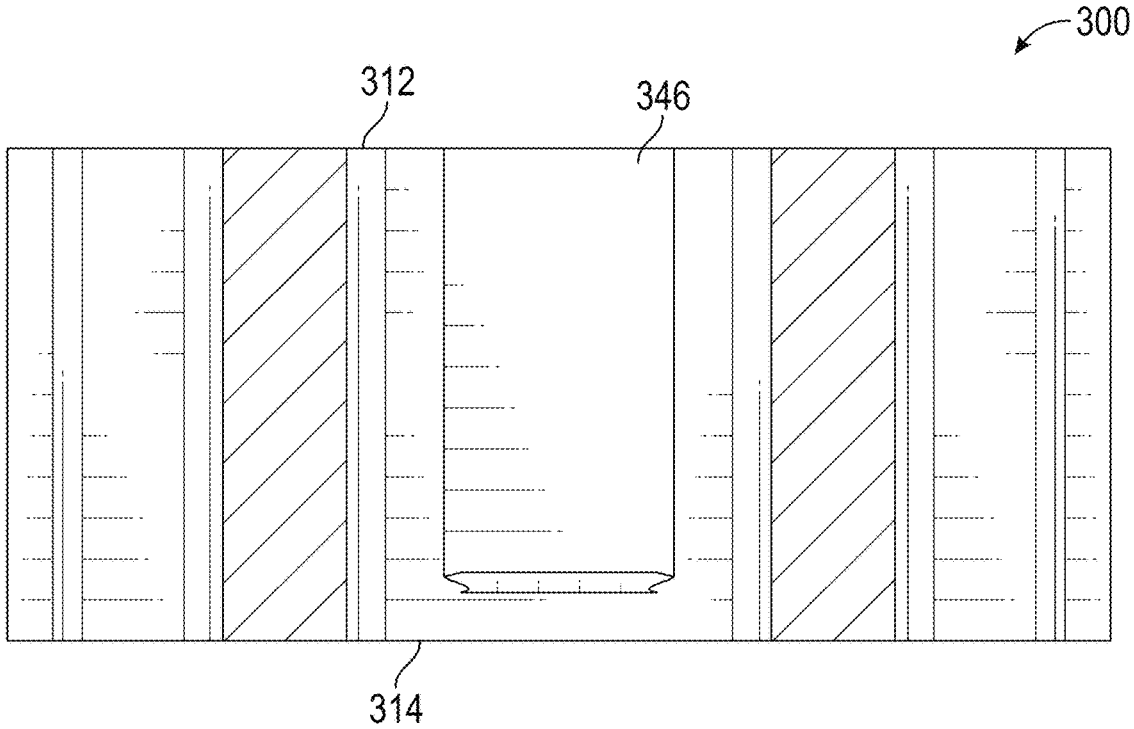
FIG. 22 is a cross-section of the wall block of FIG. 15 taken along line 22-22 of FIG. 19.

FIG. 14 shows an example of a block 200 having projections or protrusions 202 formed on the upper surface of the block. The block 200 is similar in shape to the block 10, except that the block 200 has a thicker front portion (in a front-to-back direction). The block 200 comprises an upper surface 212, an opposing lower surface (not shown), a front portion 216, a rear portion 218, and an intermediate portion 220 extending between and interconnecting the front portion 216 and the rear portion 218. The front portion 216 defines a front surface 222 of the block 200.

The rear portion 218 comprises a first tail section 224*a* and a second tail section 224*b*. The intermediate portion 220 can comprise a first leg portion 226*a* and a second leg portion 226*b*. The first leg portion 226*a* can extend between and interconnect the front portion 216 and the first tail section 224*a*. The second leg portion 226*b* can extend between and interconnect the front portion 216 and the second tail section 224*b*. The leg portions 226*a*, 226*b* can be spaced apart in a lateral direction of the block (side-to-side) by a void 228 that extends the height of the block from the upper surface 212 to the lower surface. In some examples, the void 228 may not be present.

The first tail section 224*a* defines a forward facing first surface 230*a* and a rearward facing second surface 232*a*. The second tail section 224*b* defines a forward facing first surface 230*b* and a rearward facing second surface 232*b*. As best shown in FIG. 14, the tail sections 224*a*, 224*b* are on opposite sides of a first imaginary line 34 that extends from the front portion 216 to the rear portion 218 and bisects the block 200. The second surfaces 232*a*, 232*b* can define a rear surface of the block.

The projections 202 can be formed on the upper surface of the rear portion, and are desirably, but not necessarily, positioned on quarter points of the block. In some examples, the projections desirably are centered on the quarterpoints of the block 200. The block 200 can be used to construct straight walls, convex curved walls, and concave curved walls, in the same manner as shown in FIGS. 8A-12 in connection with block 10. Thus, when constructing a wall, legs portions 226*a*, 226*b* of a block 200 can be positioned between a first projection 202 of a first underlying block 200 and a second projection 202 of an adjacent second underlying block 200. Dimensions D1, D2, D3, D4, D5, D6, D7, and D8 of the block 200 and the relationships between those dimensions can be the same or similar to those dimensions and the relationship between those dimensions disclosed for the block 10.

The front portion 216 can have a rear surface 250 that may be parallel to the front surface 222. The front portion 216 can have opposing side surfaces 252 that can taper toward each other in a direction from the front surface 222 toward the rear surface 250. In some examples, the side surfaces 252 can be perpendicular to the front surface 222 and the rear surface 250. In some examples, as shown, the front portion 216 optionally can be formed with slots or openings 254 for receiving separate block-connecting elements for interconnecting vertically adjacent blocks 200.

FIGS. 15-22 are various views of a block 300, according to another example. The block 300 can have notches 302 to facilitate removal of a section of the rear portion of the block, as further described below. The block 300 comprises an upper surface 312, an opposing lower surface 314, a front portion 316, a rear portion 318, and an intermediate portion 320 extending between and interconnecting the front portion 316 and the rear portion 318. The front portion 316 defines a front surface 322 of the block 300. The rear portion 318 defines a rear surface 323 of the block 300.

The rear portion 318 comprises a first tail section 324*a* and a second tail section 324*b*. The intermediate portion 320 can comprise a first leg portion 326*a* and a second leg portion 326*b*. The first leg portion 326*a* can extend between and interconnect the front portion 316 and the first tail section 324*a*. The second leg portion 326*b* can extend between and interconnect the front portion 316 and the second tail section 324*b*. The leg portions 326*a*, 326*b* can be spaced apart in a lateral direction of the block (side-to-side) by a void 328 that extends the height of the block from the upper surface 312 to the lower surface 314. The tail sections 324*a*, 324*b* can extend laterally away from respective leg portions 326*a*, 326*b* and can be perpendicular to the leg portions 326*a*, 326*b*.

The front portion 316 can be formed with a pair of vertically extending openings 340 that extend the height of the block from the upper surface 312 to the lower surface 314, and a pair of recesses 341 intersecting respective openings 340. The upper surface of the front portion 316 can be formed with a front recess 342 disposed along an upper front edge of each opening 340 and a rear recess 344 formed around each recess 341. The openings 340 and recesses 341, 342, 344 are configured to receive block-connecting elements for interconnecting vertically adjacent blocks.

The rear of the front portion 316 optionally can be formed with a female connection feature, such as in the form of a dovetail shaped groove 346 extending at least partially the height of the block. The groove 346 is sized and shaped to receive a correspondingly shaped connection feature of a trunk block (e.g., trunk block 900), which when connected to the block, forms a block assembly having an increased depth for greater stability for constructing relatively tall walls. However, it should be understood that the block 300 can be formed without the groove 346 if such trunk blocks are not required for the wall under construction. The groove 346 can be accessed by removing a section of the rear portion 318 of the block 300, as discussed below.

Figure 23:
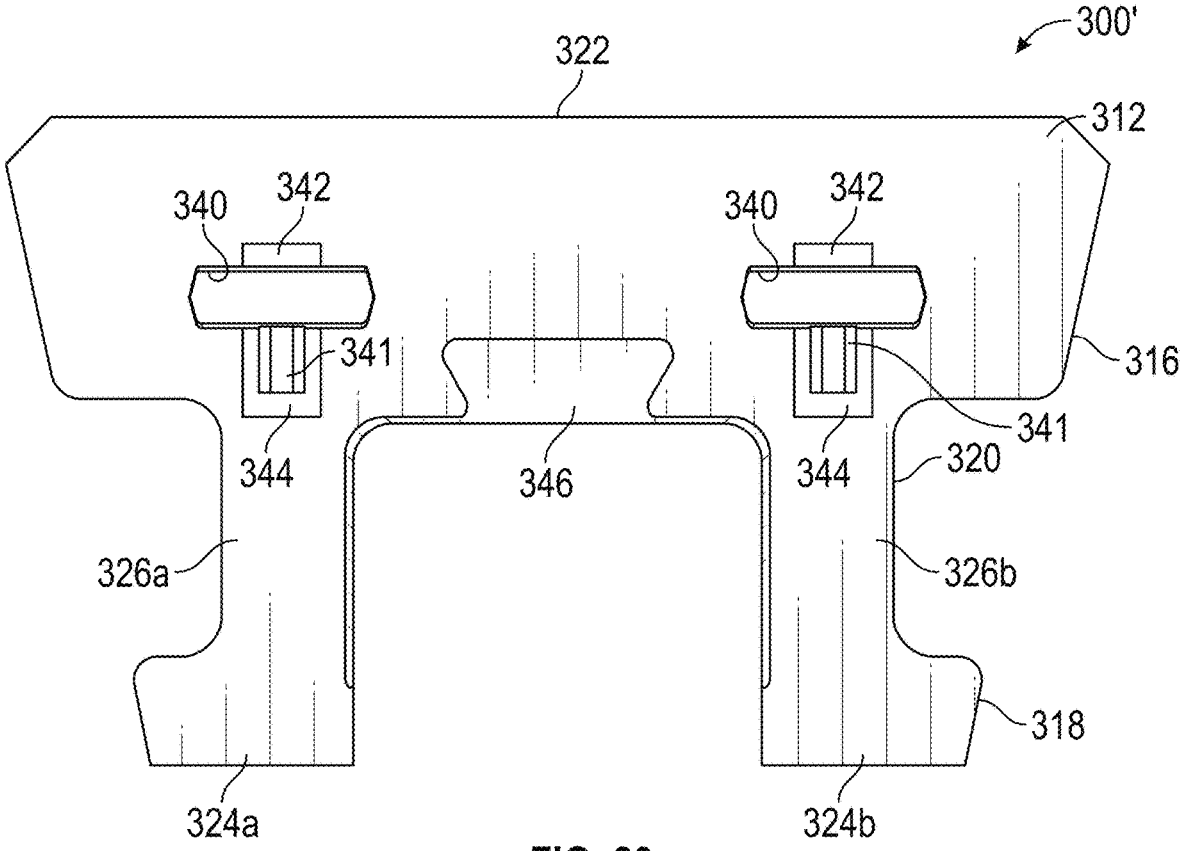
FIG. 23 is a top plan view of a wall block, according to another example.

An intermediate section 348 of the rear portion 318 between the tail sections 324*a*, 324*b* can be removed in the field, such as with a saw or a hammer and chisel. As noted above, the block 300 can be formed with notches 302, which are situated at the opposing ends of the intermediate section 348. The notches 302 can assist in the removal of the intermediate section 348. FIG. 23 shows a block 300' that is the same as block 300 except with the intermediate section 348 removed so as to form a void between the leg portions 326*a*, 326*b* and the tail sections 324*a*, 324*b* of the block. In some examples, the block 300' can be formed (e.g., molded) in the shape shown in FIG. 23; that is, the block is formed without the intermediate section 348.

Figure 24:
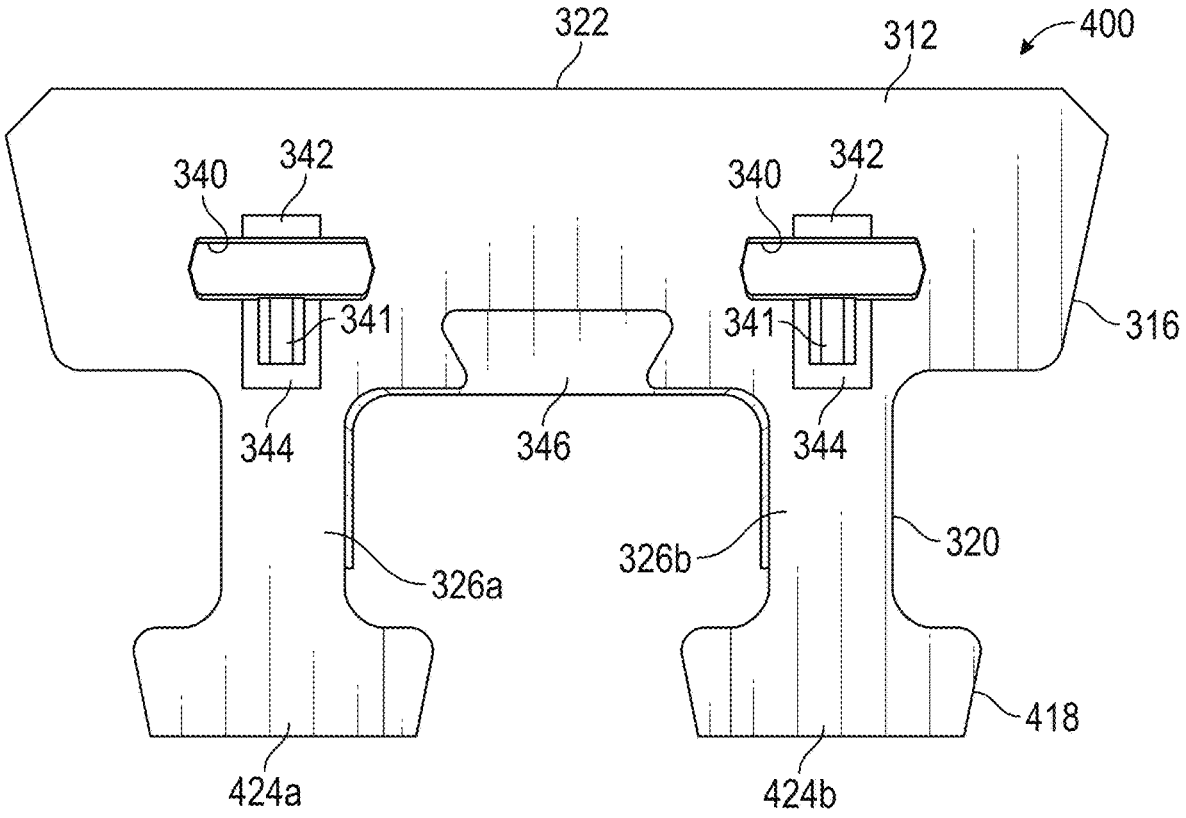
FIG. 24 is a top plan view of a wall block, according to another example.

FIG. 24 shows a block 400 that can have the same shape as the block 300', except that the tail sections and the leg portions are oriented relative to each other in a T-shaped configuration. The block 400 can have an open rear between the leg portions. Components of FIGS. 15-23 that are present in the block 400 of FIG. 24 are given the same reference numbers in FIG. 24 and are not further described for the sake of brevity. The block 400 comprises a rear portion 418 that comprises laterally spaced apart tail sections 424*a*, 424*b*, which are connected to respective leg portions 326*a*, 326 in a T-shaped configuration.

Figure 25:
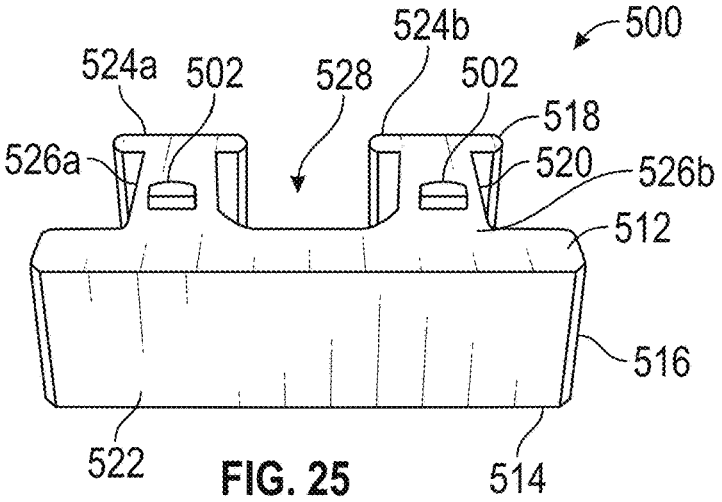
FIG. 25 is a perspective view of a wall block, according to another example.
Figure 26:
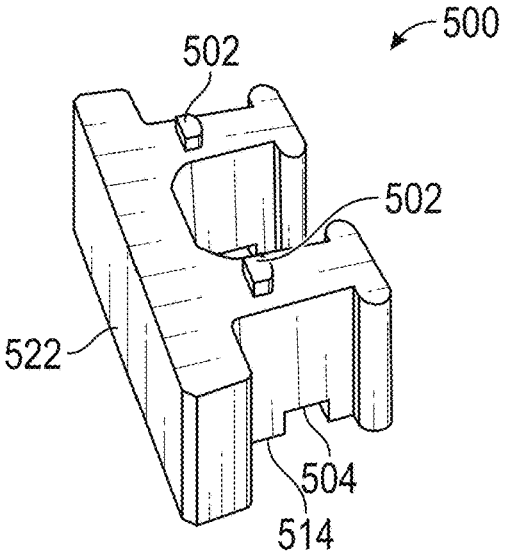
FIG. 26 is another perspective view of the wall block of FIG. 25.
Figure 27:
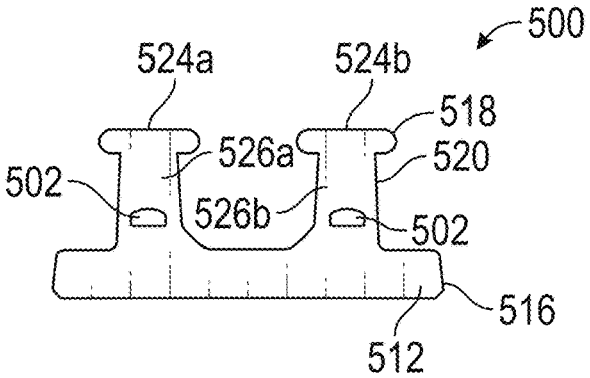
FIG. 27 is a top plan view of the wall block of FIG. 25.

FIGS. 25-27 show various views of a block 500, according to another example. The block 500 comprises an upper surface 512, an opposing lower surface 514, a front portion 516, a rear portion 518, and an intermediate portion 520 extending between and interconnecting the front portion 516 and the rear portion 518. The front portion 516 defines a front surface 522 of the block 500.

The rear portion 518 comprises a first tail section 524*a* and a second tail section 524*b*. The intermediate portion 520 can comprise a first leg portion 526*a* and a second leg portion 526*b*. The first leg portion 526*a* can extend between and interconnect the front portion 516 and the first tail section 524*a*. The second leg portion 526*b* can extend between and interconnect the front portion 516 and the second tail section 524*b*. The leg portions 526*a*, 526*b* can be spaced apart in a lateral direction of the block (side-to-side) by a void 528 that extends the height of the block from the upper surface 512 to the lower surface 514. The tail sections 524*a*, 524*b* can extend laterally away from respective leg portions 526*a*, 526*b* and can be perpendicular to the leg portions 526*a*, 526*b*. The tail sections 524*a*, 524*b* can be connected to respective leg portions 526*a*, 526*b* in a T-shaped configuration, similar to the block 400 of FIG. 24.

The tail sections 524*a*, 524*b* can be spaced apart and not interconnected to each other so as to form an opening at the rear of the block 500. Protrusions 502 are formed on the the upper surface of the leg portions 526*a*, 526*b*. The protrusions 502 can (but not necessarily) be located on the quarterpoints of the block 500, and desirably are centered on the quarterpoints of the block 500. A channel 504 can be formed in the lower surface 514 of the block 500. The protrusions 502 can be inserted into channels 504 of overlying blocks when constructing a wall to interconnect vertically adjacent blocks.

Figure 28:
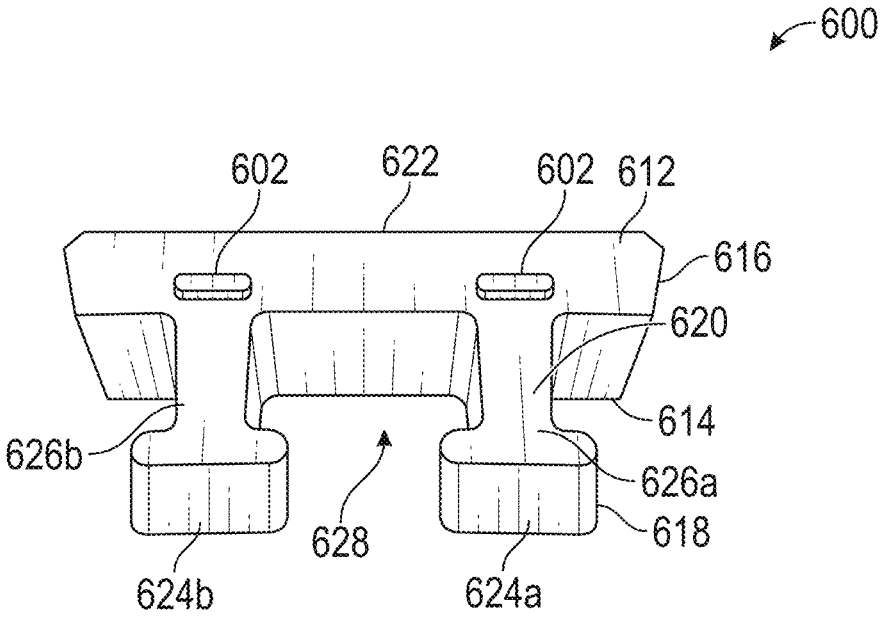
FIG. 28 is a top plan view of a wall block, according to another example.

FIG. 28 shows a block 600, according to another example. The block 600 comprises an upper surface 612, an opposing lower surface 614, a front portion 616, a rear portion 618, and an intermediate portion 620 extending between and interconnecting the front portion 616 and the rear portion 618. The front portion 616 defines a front surface 622 of the block 600.

The rear portion 618 comprises a first tail section 624*a* and a second tail section 624*b*. The intermediate portion 620 can comprise a first leg portion 626*a* and a second leg portion 626*b*. The first leg portion 626*a* can extend between and interconnect the front portion 616 and the first tail section 624*a*. The second leg portion 626*b* can extend between and interconnect the front portion 616 and the second tail section 624*b*. The leg portions 626*a*, 626*b* can be spaced apart in a lateral direction of the block (side-to-side) by a void 628 that extends the height of the block from the upper surface 612 to the lower surface 614. The tail sections 624*a*, 624*b* can extend laterally away from respective leg portions 626*a*, 626*b* and can be perpendicular to the leg portions 626*a*, 626*b*. The tail sections 624*a*, 624*b* can be connected to respective leg portions 626*a*, 626*b* in a T-shaped configuration, similar to the block 400 of FIG. 24.

The tail sections 624*a*, 624*b* can be spaced apart and not interconnected to each other so as to form an opening at the rear of the block 600. Protrusions 602 are formed on the the upper surface of the front portion 616. The protrusions 602 can (but not necessarly) be located on the quarterpoints of the block 600, and desirably are centered on the quarterpoints of the block 600. The lower surface of the block can be formed with a channel (similar to channel 504) configured to receive a protrusion 602 of an underlying block.

Figure 29:
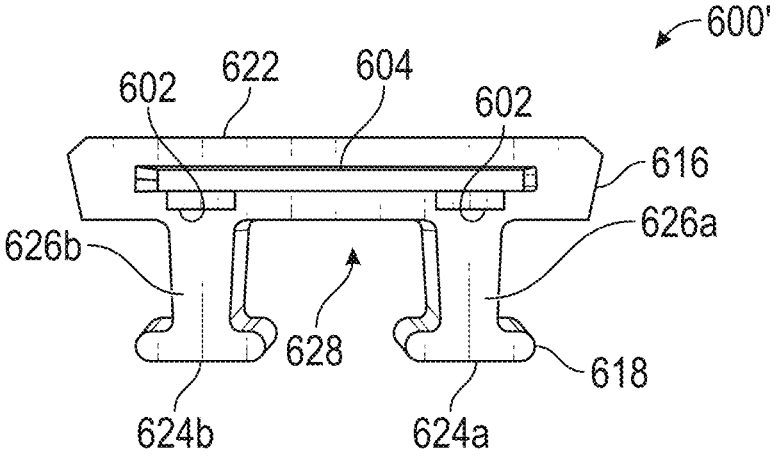
FIG. 29 is a top plan view of a wall block, according to another example.
Figure 30:
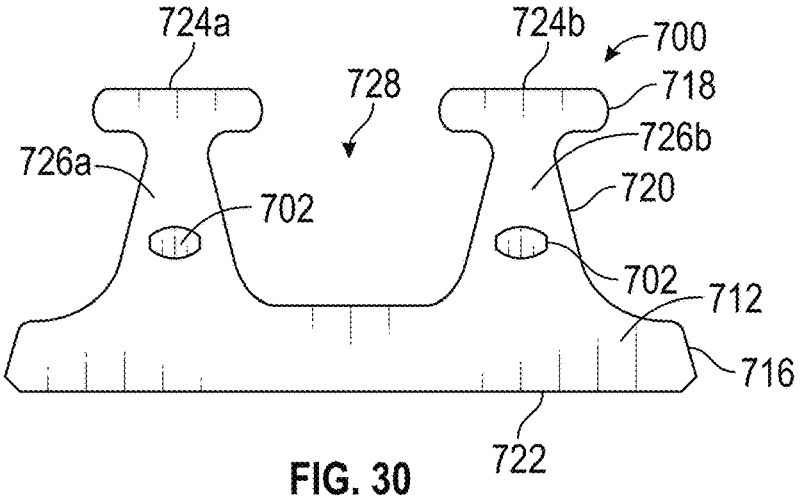
FIG. 30 is a top plan view of a wall block, according to another example.
Figure 31:
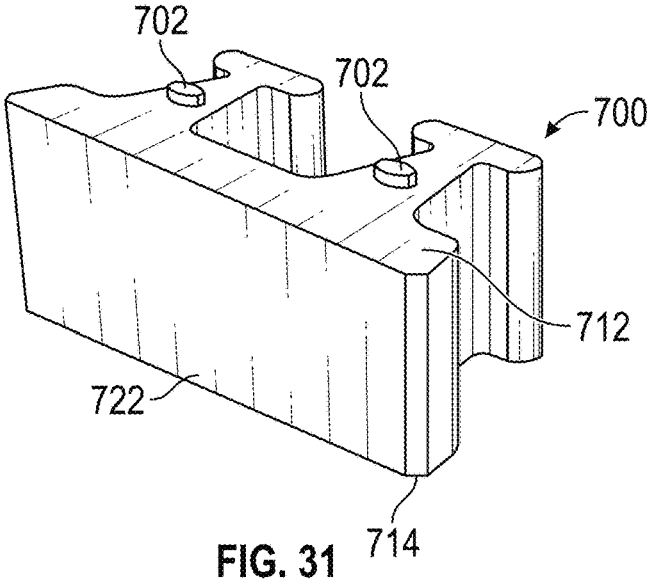
FIG. 31 is a perspective view of the wall block of FIG. 30.
Figure 32:
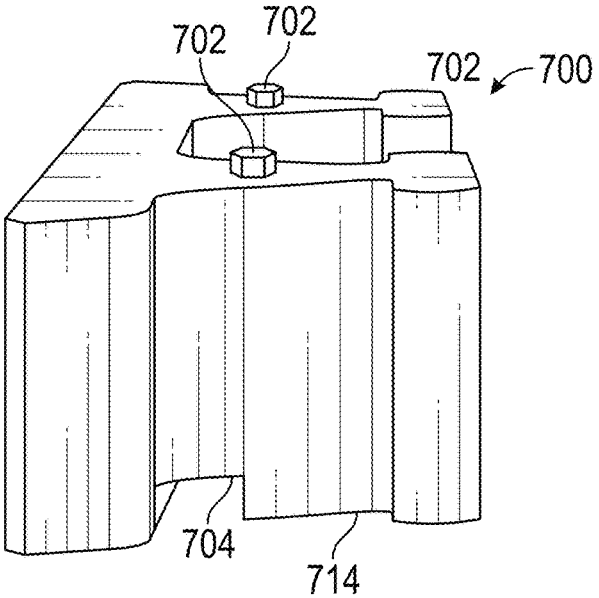
FIG. 32 is a side perspective view of the wall block of FIG. 30.
Figure 33:
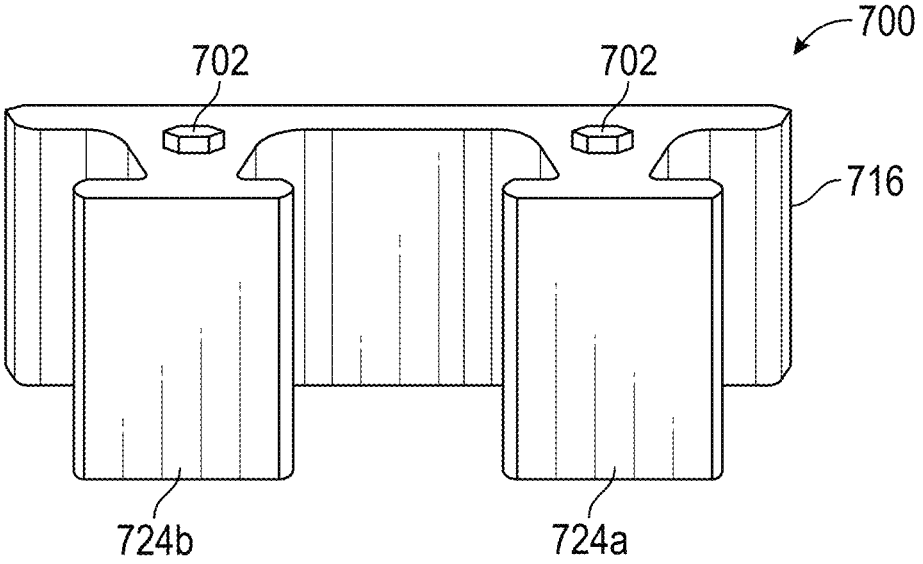
FIG. 33 is a rear perspective view of the wall block of FIG. 30.

FIG. 29 shows a block 600' that is similar to the block 600 and includes an elongated, laterally extending opening 604 extending the height of the block for receiving protrusions 602 of blocks in an underlying course for forming a wall with a batter. In some examples, the opening 604 and the protrusions 602 can be removed and an impressions can be formed at the locations of the protrusions for constructing vertical walls.

FIGS. 30-33 are various views of a block 700, according to another example. The block 700 comprises an upper surface 712, an opposing lower surface 714, a front portion 716, a rear portion 718, and an intermediate portion 720 extending between and interconnecting the front portion 716 and the rear portion 718. The front portion 716 defines a front surface 722 of the block 700.

The rear portion 718 comprises a first tail section 724*a* and a second tail section 724*b*. The intermediate portion 720 can comprise a first leg portion 726*a* and a second leg portion 726*b*. The first leg portion 726*a* can extend between and interconnect the front portion 716 and the first tail section 724*a*. The second leg portion 726*b* can extend between and interconnect the front portion 716 and the second tail section 724*b*. The leg portions 726*a*, 726*b* can be spaced apart in a lateral direction of the block (side-to-side) by a void 728 that extends the height of the block from the upper surface 712 to the lower surface 714. The tail sections 724*a*, 724*b* can extend laterally away from respective leg portions 726*a*, 726*b* and can be perpendicular to the leg portions 726*a*, 726*b*. The tail sections 724*a*, 724*b* can be connected to respective leg portions 726*a*, 726*b* in a T-shaped configuration, similar to the block 400 of FIG. 24. As shown, the leg portions 726*a*, 726*b* can have respective side walls that taper toward each other in a direction extending from the front portion 716 toward the rear portion 718 of the block.

The tail sections 724*a*, 724*b* can be spaced apart and not interconnected to each other so as to form an opening at the rear of the block 700. Protrusions 702 are formed on the the upper surface of the leg portions 726*a*, 726*b*. The protrusions 702 can (but not necessarily) be located on the quarterpoints of the block 700, and desirably are centered on the quarterpoints of the block 700. A channel 704 can be formed in the lower surface 714 of the block 700. The protrusions 702 can be inserted into channels 704 of overlying blocks when constructing a wall to interconnect vertically adjacent blocks.

Figure 34:
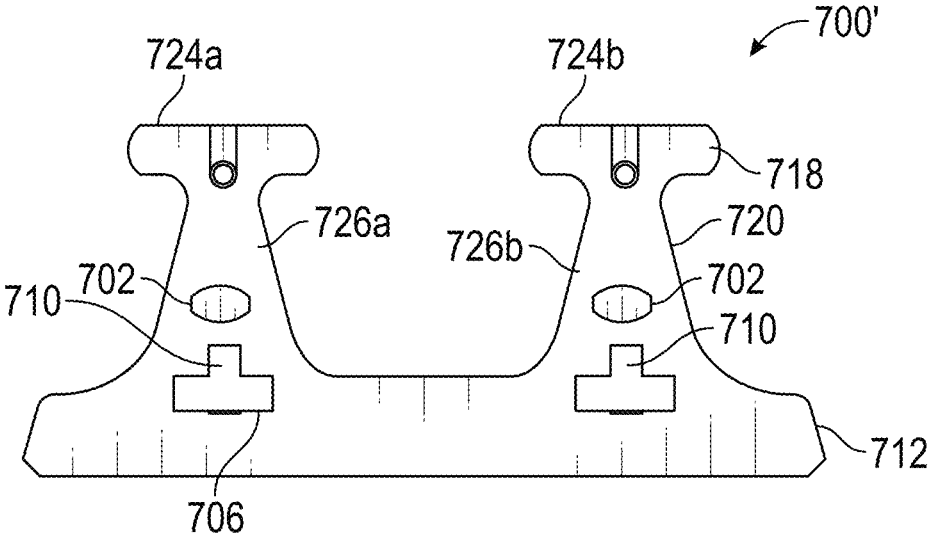
FIG. 34 is a top plan view of a wall block, according to another example.

FIG. 34 shows a block 700' similar to the block 700. Components of FIGS. 30-33 that are present in the block 700' of FIG. 34 are given the same reference numbers in FIG. 34 and are not further described for the sake of brevity. The block 700' can include openings 706 extending the height of the block and recesses 710 intersecting respective openings 706 and formed in the upper surface of the block for receiving separate block-connecting elements for interconnecting vertically adjacent blocks. Additional front and rear recesses (similar to recesses 342, 344) can be formed in the upper surface of the block adjacent the openings 706 and recesses 710. If block-connecting elements are used, the block 700' can be formed without the protrusions 702.

Figure 35:
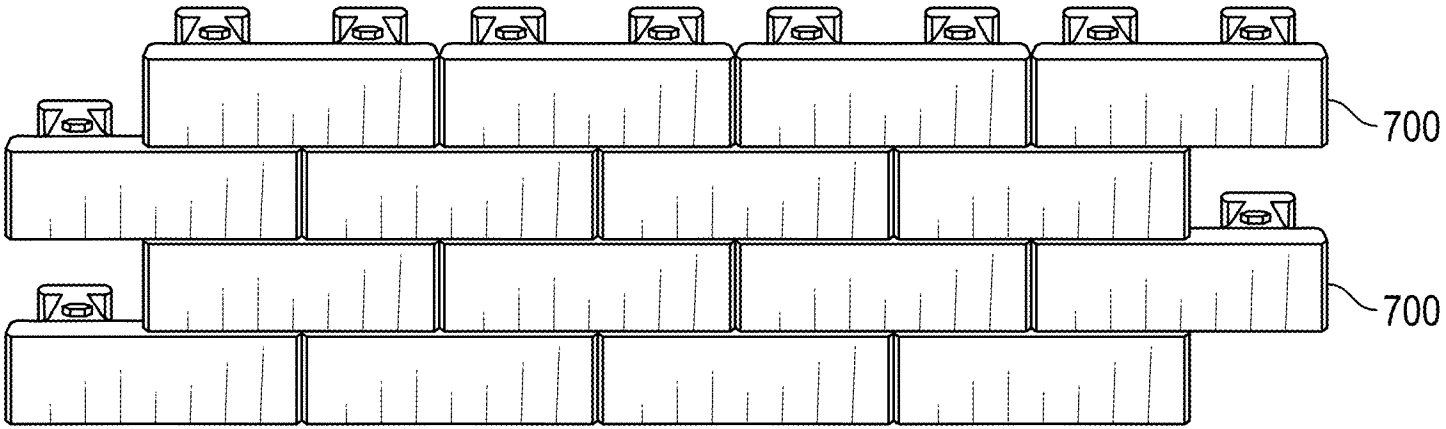
FIG. 35 is front perspective view of a wall constructed from blocks of the type shown in FIG. 30.
Figure 36:
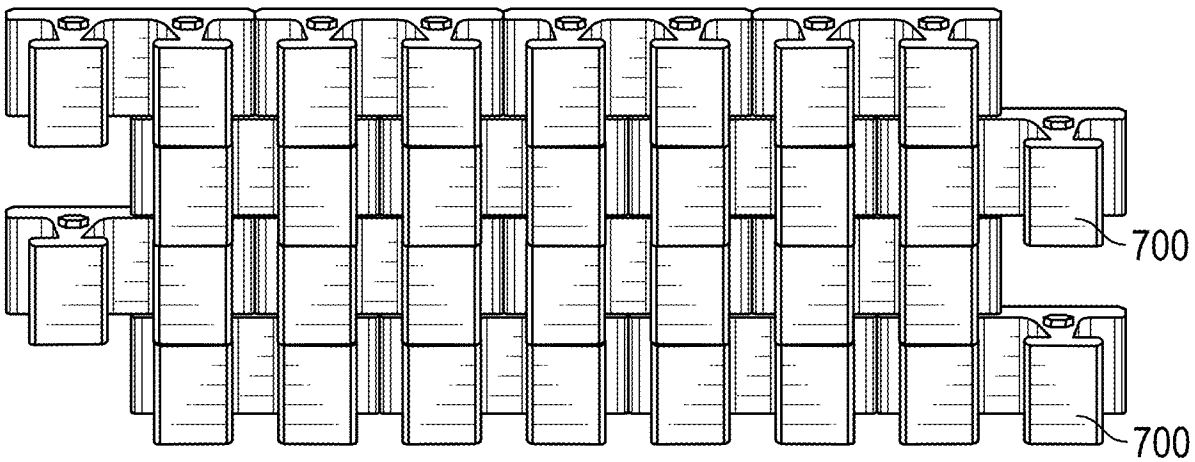
FIG. 36 is a rear perspective view of the wall of FIG. 35.
Figure 37:
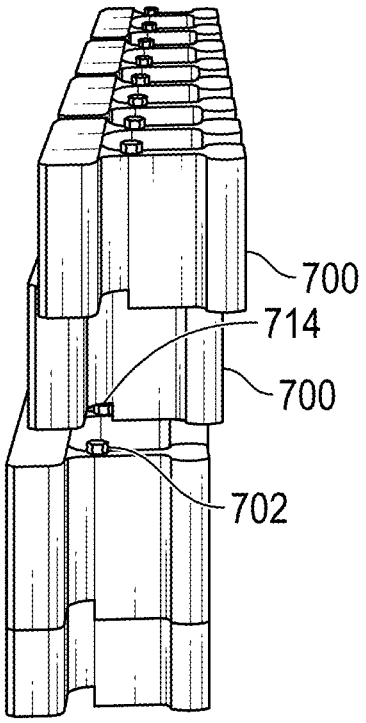
FIG. 37 is side perspective view of the wall of FIG. 35.

FIGS. 35-37 are various views of a wall constructed from multiple blocks 700, showing protrusions 702 received within channels 704. As shown, the blocks 700 are stacked in a running bond pattern, with each block 700 straddling two blocks in an adjacent lower course. One projection 702 of an underlying block 700 extends into a channel 704 of an overlying block and the other projection 702 of the underlying block extends into a channel 704 of another overlying block.

Figure 38:
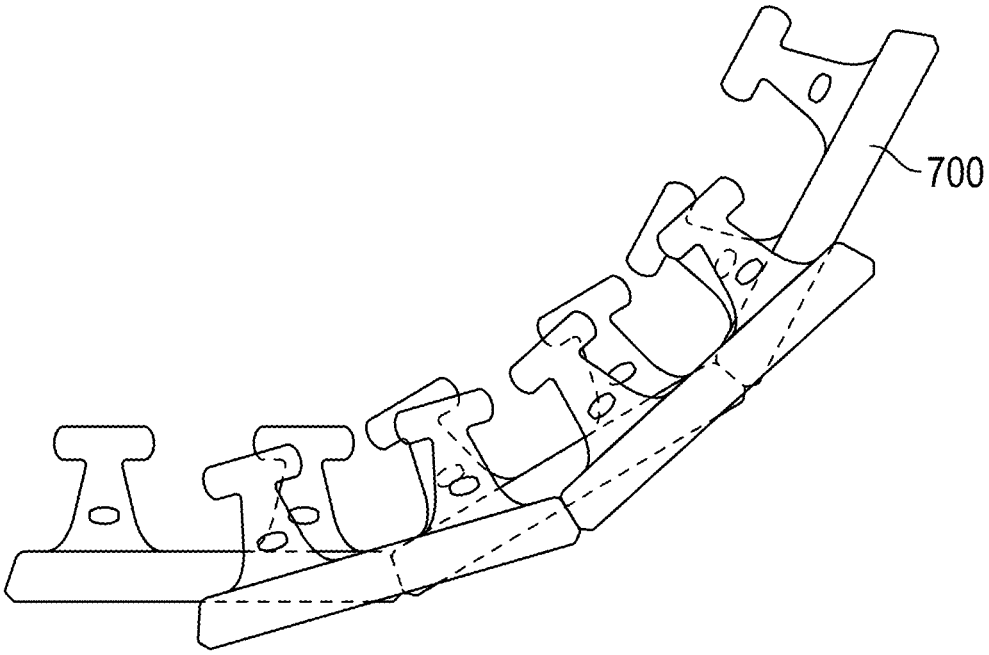
FIG. 38 is a top plan view of a convex wall constructed from blocks of the type shown in FIG. 30.

FIG. 38 shows a convex curved wall constructed from blocks 700.

Figure 39:
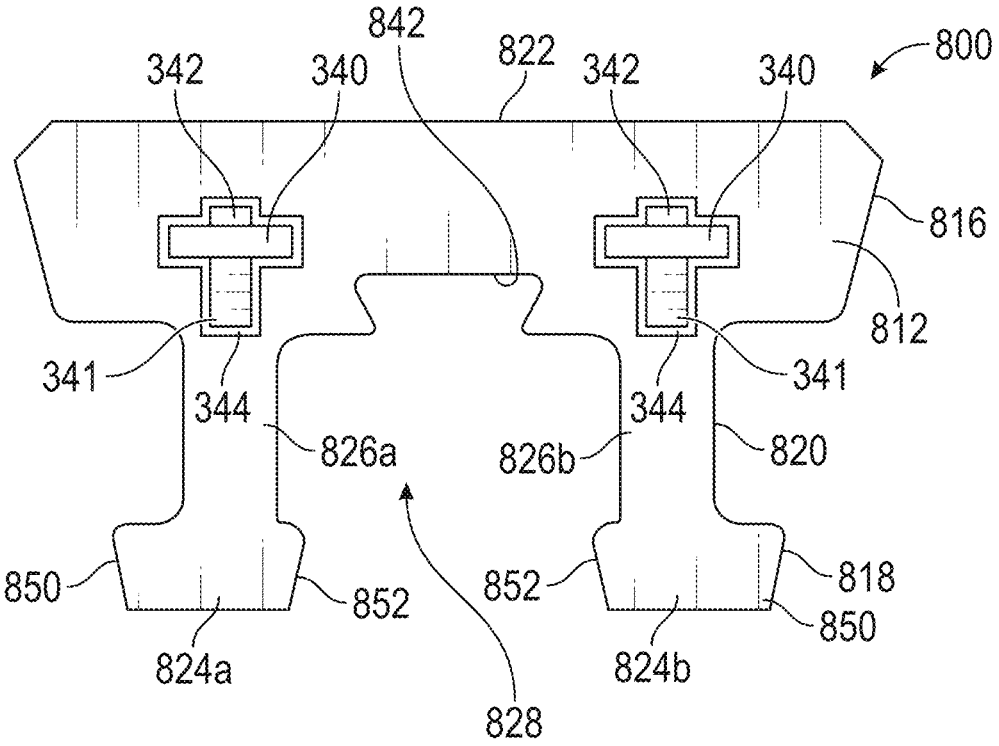
FIG. 39 is a top plan view of a wall block, according to another example.
Figure 40:
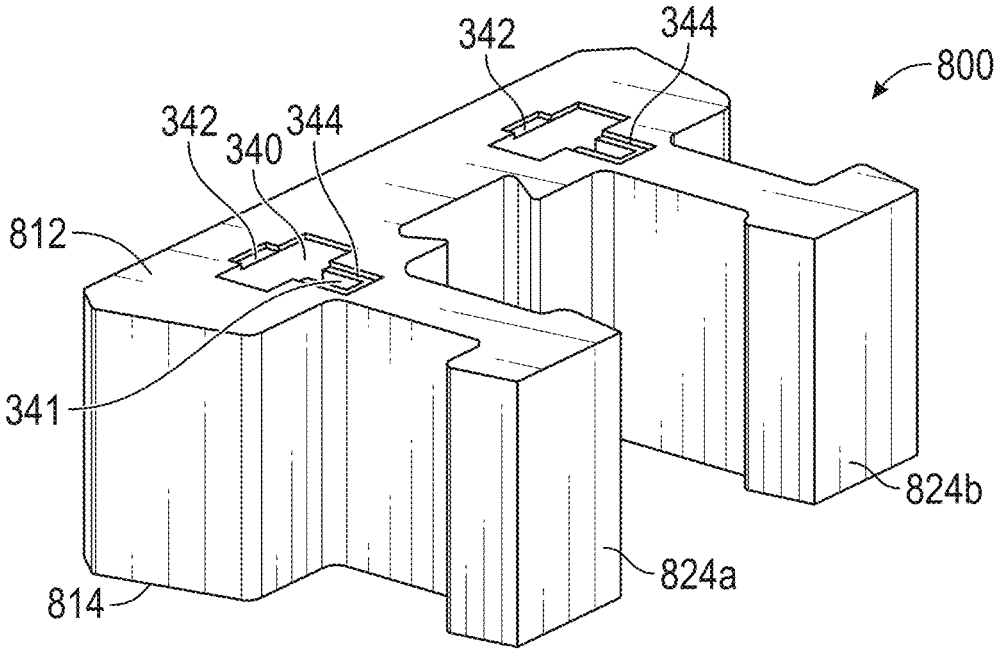
FIG. 40 is a perspective view of the wall block of FIG. 39.

FIGS. 39-40 show a block 800, according to another example. The block 800 comprises an upper surface 812, an opposing lower surface 814, a front portion 816, a rear portion 818, and an intermediate portion 820 extending between and interconnecting the front portion 816 and the rear portion 818. The front portion 816 defines a front surface 822 of the block 800.

The rear portion 818 comprises a first tail section 824*a* and a second tail section 824*b*. The intermediate portion 820 can comprise a first leg portion 826*a* and a second leg portion 826*b*. The first leg portion 826*a* can extend between and interconnect the front portion 816 and the first tail section 824*a*. The second leg portion 826*b* can extend between and interconnect the front portion 816 and the second tail section 824*b*. The leg portions 826*a*, 826*b* can be spaced apart in a lateral direction of the block (side-to-side) by a void 828 that extends the height of the block from the upper surface 812 to the lower surface 814. The tail sections 824*a*, 824*b* can extend laterally away from respective leg portions 826*a*, 826*b* and can be perpendicular to the leg portions 826*a*, 826*b*.

The tail sections 824*a*, 824*b* can be spaced apart and not interconnected to each other so as to form an opening at the rear of the block 800; that is, the void 828 forms an opening at the rear of the block. In the illustrated example, similar to the block 300, the front portion 816 of the block 800 can have openings 340 extending the height of the block, recesses 341, and front recesses 342 and rear recesses 344 formed in the upper surface of the block for receiving separate block-connecting elements for interconnecting vertically adjacent blocks, as further described below.

The tails sections 824*a*, 824*b* can be asymmetric with respect to imaginary lines extending front-to-back of the block through the leg portions 824*a*, 824*b*. For example, each tail section 824*a*, 824*b* can have an outboard portion 850 that extends laterally outwardly from the respective leg portion 826*a*, 826*b* and an inboard portion 852 that extends laterally inwardly from the respective leg portion 826*a*, 826*b*, with the outboard portions 850 being longer than the inboard portions 852.

The rear of the front portion optionally can be formed with a female connection feature, such as in the form of a dovetail shaped groove 842 extending at least partially the height of the block. The groove 842 is sized and shaped to receive a correspondingly shaped connection feature of a trunk block, which when connected to the block, forms a block assembly having an increased depth for greater stability for constructing relatively tall walls. However, it should be understood that the block 800 can be formed without the groove 842 if such trunk blocks are not required for the wall under construction.

Figure 41:
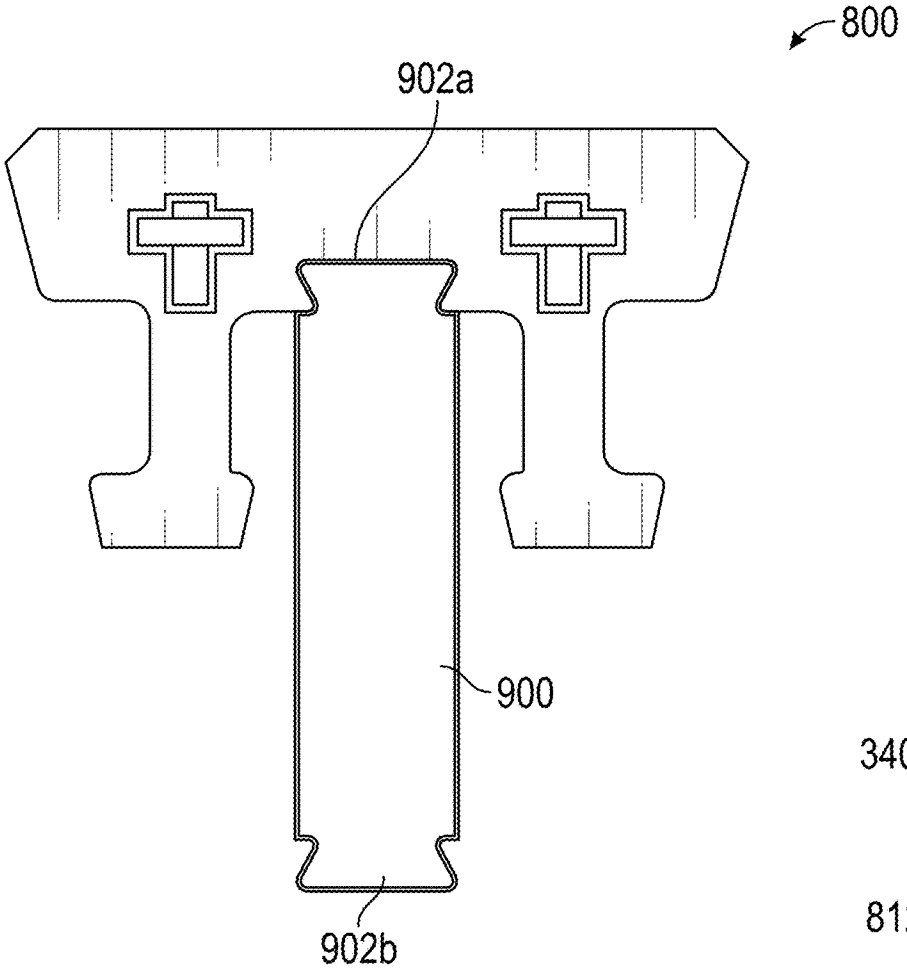
FIG. 41 is a top plan view of a wall block assembly comprising the wall block of FIG. 39 and a trunk block, according to one example.

FIG. 41 shows the block 800 connected to an exemplary trunk block 900, which has male-connecting features 902*a*, 902*b* on one or both ends of the block 900. The male-connecting features 902*a*, 902*b* can have a shape complementary to the shape of the groove 842, such as dove-tail shaped projection. As shown in FIG. 41, one male-connecting feature 902*a* can be inserted into the groove 842 of the block 800 to form a block assembly that has an increased depth compared to the block 800 alone. Another block with a groove 842 (not shown), such as another block 800 can be connected to the male-connecting feature 902*b* of the block 900. The trunk block 900 can be used in the same manner with any of the blocks described herein with a dovetail shaped groove (e.g., blocks 10, 200, 300', 400).

Figure 42:
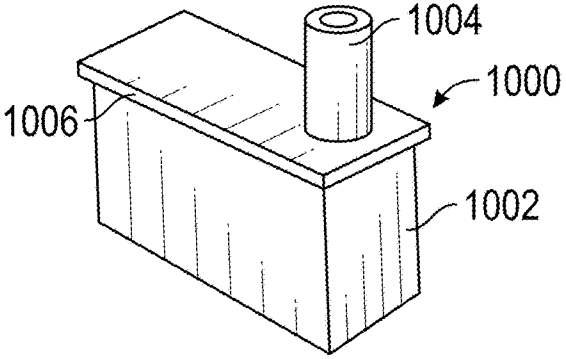
FIG. 42 is a perspective view of a block-connecting element, according to one example.

FIG. 42 shows a block-connecting element 1000, according to one example, that can be used with the block 800. The block-connecting element 1000 comprises a lower portion, or base, 1002, and an upper portion, or projection, 1004 extending upwardly from the base 1002. In the illustrated example, the base 1002 has a rectangular cross-sectional profile and the projection 1004 is cylindrical, although other shapes can be used for these two components. The upper portion of the base 1002 can form a flange 1006 that extends around the upper perimeter of the base 1002.

The block-connecting element 1000 can be positioned in two orientations in a block 800. FIG. 43A shows a forward position for the block-connecting element 1000 in which the base 1002 is disposed in the recess 341 and the flange 1006 is disposed in recesses 342, 344 with the projection 1004 closer to the front edge of the opening 340. When forming the next course of the blocks 800 over a previously laid course of blocks 800, the projection 1004 is inserted into an opening 340 of an overlying block in the next course. When the block-connecting element 1000 is in the forward position, the blocks of the previously laid course and the next course are stacked on top of each other to form a vertical wall without a batter.

Figure 43B:
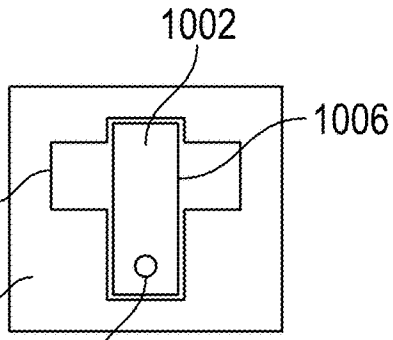
FIG. 43B illustrates a rearward orientation of the block-connecting element of FIG. 42 in the wall block of FIG. 39.
Figure 43A:
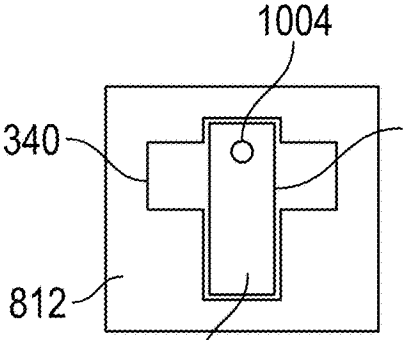
FIG. 43A illustrates a forward orientation of the block-connecting element of FIG. 42 in the wall block of FIG. 39.

FIG. 43B shows a rearward position for the block-connecting element 1000 in which the base 1002 is disposed in the recess 341 and the flange 1006 disposed in the recesses 342, 344 with the projection 1004 rearward of the rear edge of the opening 340. When forming the next course of the blocks 800 over a previously laid course of blocks 800, the projection 1004 is inserted into an opening 340 of an overlying block in the next course. When the block-connecting element 1000 is in the rearward position, the blocks of the next course are set back with respect to the blocks of the previously laid course to form a vertical wall with a positive batter. The block-connecting element 1000 can be used as shown in FIGS. 43A-43B for constructing walls with blocks that have the same or similar openings and recesses configured to receive a block-connecting element 1000 (e.g., blocks 300, 300', 400, and 700').

Figure 44:
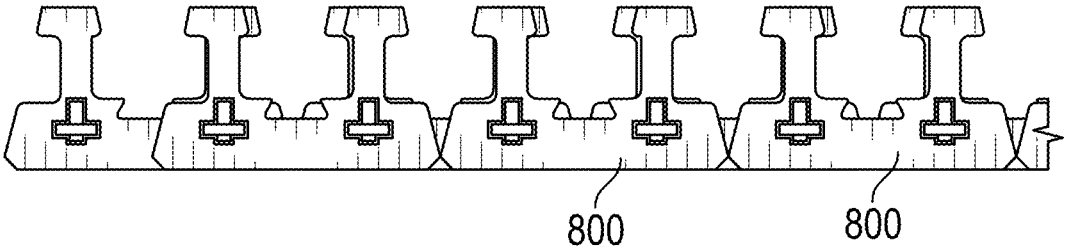
FIGS. 44-46 are various views of a wall constructed from blocks of the type shown in FIG. 39.
Figure 45:
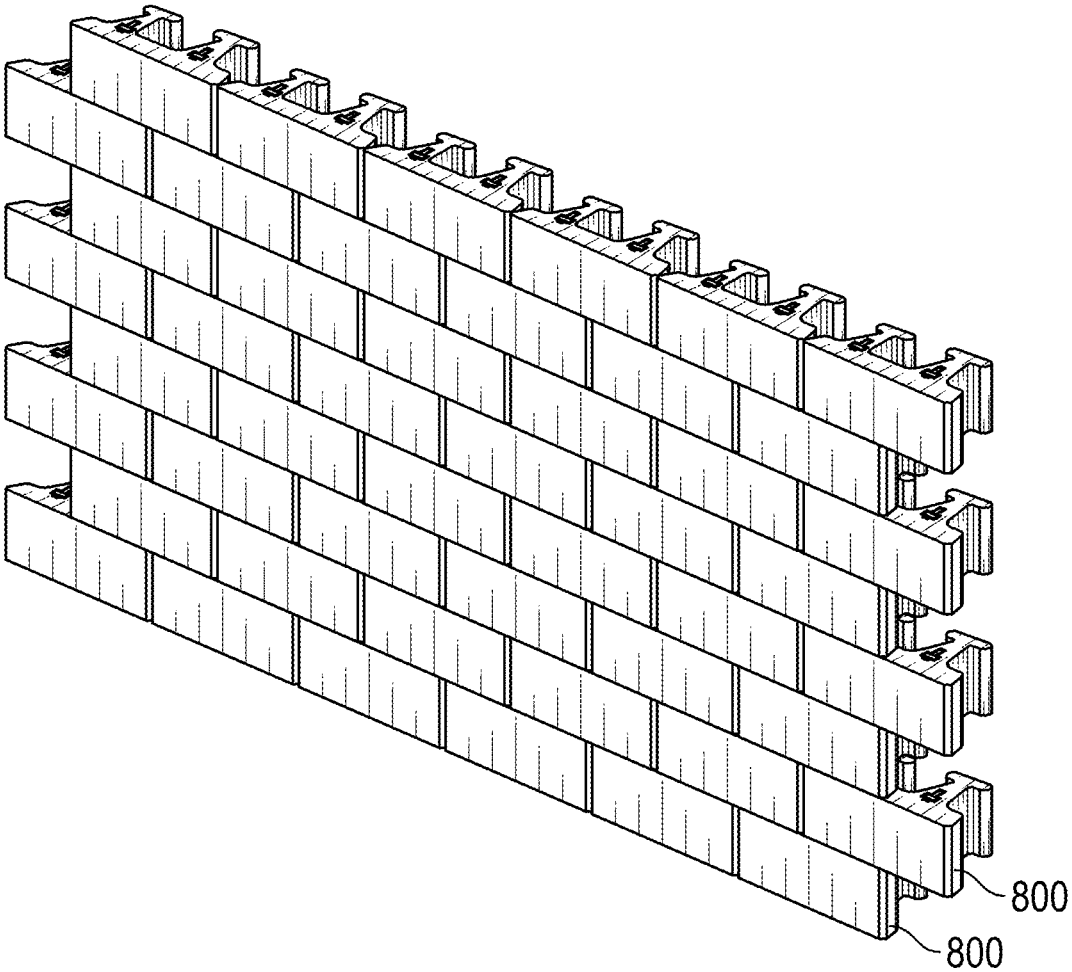
Figure 46:
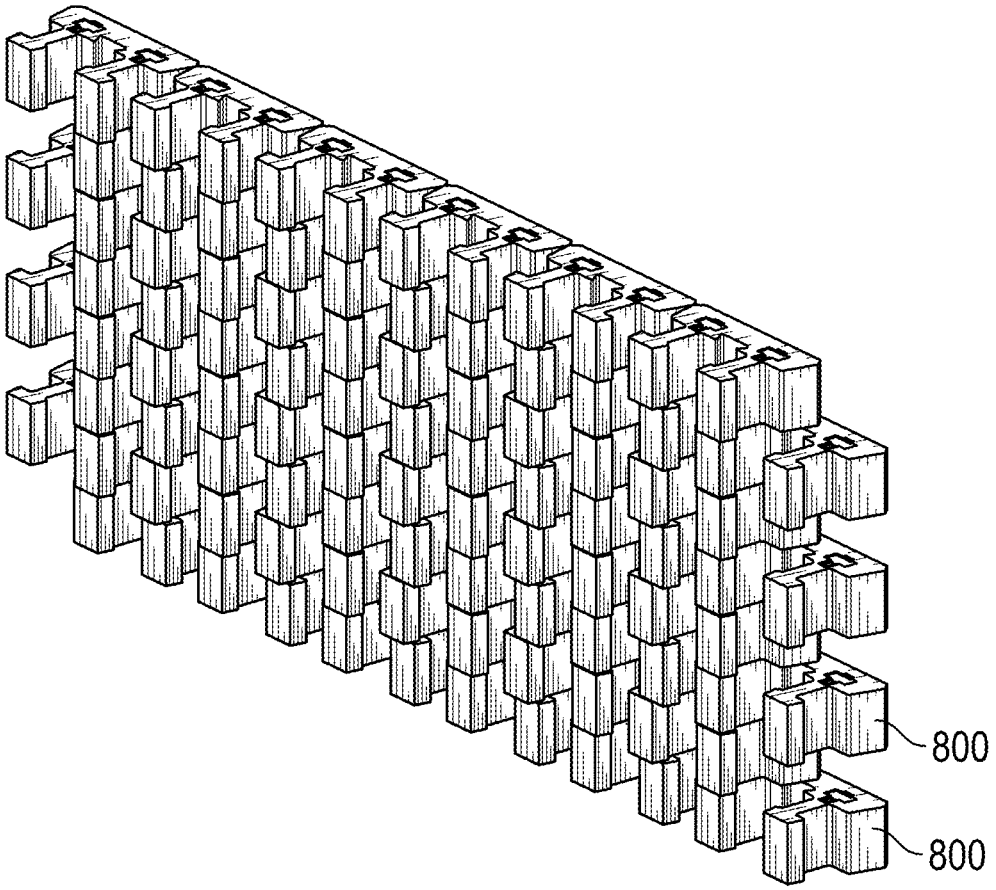

FIGS. 44-46 show various views of a wall constructed from multiple blocks 800. The wall of FIGS. 44-46 is an example of a vertical wall with the blocks 800 stacked on top of each other without a batter. Blocks 800 in adjacent courses can be interconnected to each other by block-connecting elements 1000 positioned in a forward orientation (FIG. 43A). As shown, the blocks 800 are stacked in a running bond pattern, with each block 800 straddling two blocks in an adjacent lower course. The projection 1004 of one block-connecting element 1000 of an underlying block 800 extends into an opening 340 of an overlying block and the projection 1004 of the other block-connecting element 1000 of the underlying block extends into an opening 340 of another overlying block.

Further disclosure about using block-connecting elements for constructing walls is disclosed in U.S. Pat. Nos. 8,667,759 and 7,503,729, which are incorporated herein by reference. U.S. Pat. No. 7,503,729 also discloses a trunk block that can be assembled with another block to form a multi-block assembly.

Any of the blocks disclosed herein that have openings and recesses for receiving a block-connecting element (e.g., blocks 300, 300', 400, and 700') can alternatively be formed with protrusions (e.g., protrusions 36*a*, 36*b*) on the upper surface of the block for engaging a vertically adjacent, overlying block. In any such examples, the protrusions can be located closer to the rear surface of the block than the front surface of the block (such as disclosed for blocks 10, 200) or located closer to the front surface of the block than the rear surface of the block (such as disclosed for blocks 600, 600') or located midway or about midway between the front surface of the block and the rear surface of the block (such as disclosed for blocks 500, 700, 700'). For example, blocks 300, 800 can be modified to include protrusions (e.g., protrusions 36*a*, 36*b*) on the leg portions or tail sections of those blocks. If the block includes protrusions on the upper surface, the lower surface can be formed with a channel to receive the protrusions, or the intermediate portion of the block (e.g., the legs) can be configured and/or located relative to the protrusions to permit stacking (D3 is less than twice D4).

The protrusions of any block disclosed herein can have any of various shapes, such as rectangular (e.g., protrusions 36*a*, 36*b*), square, square or rectangular with one or more rounded corners (e.g., protrusions 202), oval, elliptical, circular, triangular, etc., and/or combinations thereof. In some examples, the protrusions can have one or more curved surfaces (e.g., protrusions 502, which have curved rear surfaces, or protrusions 702, which have curved front and rear surfaces).

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

I claim:

1. A wall block comprising:

an upper surface and a lower surface;

a front portion defining a front surface of the block, a rear portion, and an intermediate portion extending between and interconnecting the front portion and the rear portion;

wherein the intermediate portion comprises first and second leg portions extending from the front portion to the rear portion, wherein the first and second leg portions are separated laterally from each other by a void in the block, and wherein the first and second leg portions define a minimum spacing (D3) measured from an outer side surface of the first leg portion to an outer side surface of the second leg portion;

wherein the rear portion comprises a first tail section and a second tail section positioned on opposite sides of a first imaginary line extending from the front portion to the rear portion and bisecting the block, wherein each of the first and second tail sections comprises a forward facing first surface and an opposing rearward facing second surface;

wherein the first leg portion is connected to the first tail section and the second leg portion is connected to the second tail section; and first and second protrusions formed on the upper surface of the block, wherein the first and second protrusions are located on opposite sides of the first imaginary line and rearward of a second imaginary line, wherein the second imaginary line extends laterally of the block and is equidistant from the front surface and the second surfaces of the tail sections;

wherein an outboard side of the first protrusion is spaced a distance (D4) from a third imaginary line that is parallel to the first imaginary line and intersects a lateral most location of a first side of the block;

wherein an outboard side of the second protrusion is spaced the distance (D4) from a fourth imaginary line that is parallel to the first imaginary line and intersects a lateral most location of a second side of the block;

wherein the minimum spacing (D3) is less than twice the distance (D4).

2. The wall block of claim 1, wherein the forward facing first surfaces of the first and second tail sections are parallel to the front surface of the block.

3. The wall block of claim 2, wherein the rearward facing second surfaces of the first and second tail sections are parallel to the front surface of the block.

4. The wall block of claim 3, wherein each tail section has a length that is perpendicular to the first imaginary line.

5. The wall block of claim 3, wherein the first leg portion comprises a concave side surface portion that intersects the forward facing first surface of the first tail section and the second leg portion comprises a concave side surface portion that intersects the forward facing first surface of the second tail section.

6. The wall block of claim 1, wherein the first protrusion is formed on the first tail section and the second protrusion is formed on the second tail section.

7. The wall block of claim 1, wherein the first and second protrusions are offset from the second surfaces of the tail sections a first distance and offset from the front surface a second distance, wherein the second distance is greater than the first distance.

8. A wall block comprising:

an upper surface and a lower surface; and a front portion defining a front surface of the block, a rear portion, and an intermediate portion extending between and interconnecting the front portion and the rear portion;

wherein the intermediate portion defines a minimum spacing (D3) measured from an outer side surface of the intermediate portion to another, opposing outer side surface of the intermediate portion;

wherein the rear portion comprises a first tail section and a second tail section positioned on opposite sides of a first imaginary line extending from the front portion to the rear portion and bisecting the block, wherein each of the first and second tail sections comprises a forward facing first surface and an opposing rearward facing second surface;

first and second protrusions formed on the upper surface of the block, wherein the first and second protrusions are located on opposite sides of the first imaginary line and are closer to the second surfaces of the tail sections than they are to the front surface of the block;

wherein an outboard side of the first protrusion is spaced a distance (D4) from a second imaginary line that is parallel to the first imaginary line and intersects a lateral most location of a first side of the block;

wherein an outboard side of the second protrusion is spaced the distance (D4) from a third imaginary line that is parallel to the first imaginary line and intersects a lateral most location of a second side of the block;

wherein the minimum spacing (D3) is less than twice the distance (D4).

9. The wall block of claim 8, wherein the first and second protrusions are offset from the second surfaces of the tail sections a first distance and offset from the front surface a second distance, wherein the second distance is greater than the first distance.

10. The wall block of claim 9, wherein the intermediate portion comprises first and second leg portions extending from the front portion to the rear portion, wherein first and second leg portions are separated laterally from each other by a void in the block.

11. The wall block of claim 10, wherein the first leg portion is connected to the first tail section and the second leg portion is connected to the second tail section.

12. The wall block of claim 11, wherein each tail section has a length that is perpendicular to the first imaginary line.

13. The wall block of claim 11, wherein the first leg portion comprises a concave side surface portion that intersects the forward facing first surface of the first tail section and the second leg portion comprises a concave side surface portion that intersects the forward facing first surface of the second tail section.

14. The wall block of claim 11, wherein the front surface of the block is parallel to the rearward facing second surfaces of the tail sections.

15. The wall block of claim 11, wherein the forward facing first surfaces of the tail sections are parallel to the rearward facing second surfaces of the tail sections.

16. The wall block of claim 8, wherein the first protrusion is formed on the first tail section and the second protrusion is formed on the second tail section.

17. A wall comprising:

at least a first lower course and a second upper course overlying the first course, wherein each course comprises a plurality of first blocks;

wherein each first block comprises:

an upper surface and a lower surface;

a front portion defining a front surface of the block, a rear portion, and an intermediate portion extending between and interconnecting the front portion and the rear portion;

wherein the intermediate portion defines a minimum spacing (D3) measured from an outer side surface of the intermediate portion to another, opposing outer side surface of the intermediate portion;

wherein the rear portion comprises a first tail section and a second tail section positioned on opposite sides of a first imaginary line extending from the front portion to the rear portion and bisecting the block, wherein each of the first and second tail sections comprises a forward facing first surface and an opposing rearward facing second surface;

first and second protrusions formed on the upper surface of the block, wherein the first and second protrusions are located on opposite sides of the first imaginary line and are closer to the second surfaces of the tail sections than they are to the front surface of the block;

wherein an outboard side of the first protrusion is spaced a distance (D4) from a second imaginary line that is parallel to the first imaginary line and intersects a lateral most location of a first side of the block;

wherein an outboard side of the second protrusion is spaced the distance (D4) from a third imaginary line that is parallel to the first imaginary line and intersects a lateral most location of a second side of the block;

wherein the minimum spacing (D3) is less than twice the distance (D4):

wherein the protrusions of the first blocks in the first course engage respective forward facing first surfaces of tail sections of respective first blocks in the second course such that the first blocks in the second course are set back relative to the first blocks in the first course.

18. The wall of claim 17, wherein the wall comprises a straight section.

19. The wall of claim 17, wherein the wall comprises a concave curved section.

20. The wall of claim 17, wherein the wall comprises a convex curved section.

* * * * *